US011758972B2

(12) United States Patent
Hopkins et al.

(10) Patent No.: US 11,758,972 B2
(45) Date of Patent: Sep. 19, 2023

(54) FOOTWEAR ARTICLE WITH COLLAR ELEVATOR

(71) Applicant: NIKE, Inc., Beaverton, OR (US)

(72) Inventors: Timothy P. Hopkins, Lake Oswego, OR (US); Andrew A. Owings, Portland, OR (US); Haley Toelle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/839,744

(22) Filed: Apr. 3, 2020

(65) Prior Publication Data

US 2020/0229536 A1 Jul. 23, 2020

Related U.S. Application Data

(63) Continuation of application No. 16/230,907, filed on Dec. 21, 2018, now Pat. No. 10,617,174.

(51) Int. Cl.

| | |
|---|---|
| ***A43B 11/00*** | (2006.01) |
| ***A43B 23/02*** | (2006.01) |
| ***A43B 23/08*** | (2006.01) |
| ***A43B 5/00*** | (2022.01) |
| ***A43B 13/14*** | (2006.01) |
| ***A43B 23/26*** | (2006.01) |

(52) U.S. Cl.

CPC ..... *A43B 11/00* (2013.01); *A43B 23/027* (2013.01); *A43B 23/088* (2013.01); *A43B 5/00* (2013.01); *A43B 13/148* (2013.01); *A43B 23/26* (2013.01)

(58) Field of Classification Search

CPC ..... A43B 11/00; A43B 11/02; A43B 23/027; A43B 23/088; A43B 23/28

See application file for complete search history.

(56) References Cited

U.S. PATENT DOCUMENTS

| | | | |
|---|---|---|---|
| 91,547 | A | 6/1869 | Leathe |
| 112,439 | A | 3/1871 | Francis |
| 219,436 | A | 9/1879 | Beneke |
| 487,860 | A | 12/1892 | Vail |
| 827,330 | A | 7/1906 | Tillson |
| 863,549 | A | 8/1907 | Metz |

(Continued)

FOREIGN PATENT DOCUMENTS

| | | | |
|---|---|---|---|
| CN | 2138904 | Y | 7/1993 |
| CN | 2438353 | Y | 7/2001 |

(Continued)

OTHER PUBLICATIONS

Translation of WO2009154350, Shim, Sang-Ok, Dec. 23, 2009, translated via WIPO (Year: 2009).*

(Continued)

*Primary Examiner* — Heather Mangine

(74) *Attorney, Agent, or Firm* — SHOOK, HARDY & BACON LLP

(57) ABSTRACT

A footwear article includes a collar elevator to raise an ankle collar from a lowered position to a raised position. For example, the ankle collar may be lowered when a wearer slides a foot into or out of the footwear article. The collar elevator may include a forwardly inclined angle. In addition, the footwear article may include a doffing ledge, in some instances, which includes characteristics based on the forwardly inclined angle.

8 Claims, 8 Drawing Sheets

(56) References Cited

U.S. PATENT DOCUMENTS 882,109 A 3/1908 Harris
905,323 A 12/1908 King et al.
911,025 A 2/1909 Blaisdell
1,028,598 A 6/1912 Papp
1,081,678 A 12/1913 Langerak
1,155,354 A 10/1915 Hallock
1,275,895 A 8/1918 Fox
1,464,342 A 8/1923 Rothacher
1,494,236 A 5/1924 Greathouse
1,515,086 A 11/1924 Baluta
1,686,175 A 10/1928 Read
1,736,110 A 11/1929 Beemer
1,972,899 A 9/1934 Odell
D98,150 S 1/1936 Drake
2,069,752 A 2/1937 Dorr
2,097,810 A 11/1937 Dawes
2,450,250 A 9/1948 Napton
2,452,502 A 10/1948 Tarbox
2,513,005 A 6/1950 Nancy
2,523,221 A 9/1950 Craven
2,736,110 A 2/1956 Hardimon
2,920,402 A 1/1960 Minera
2,942,359 A 6/1960 Bushway et al.
3,146,535 A 9/1964 Owings
3,192,651 A 7/1965 Smith
4,489,509 A 12/1984 Libit
4,608,769 A * 9/1986 Sturlaugson ..... A43B 11/02 36/138
4,876,806 A 10/1989 Robinson et al.
4,972,613 A 11/1990 Loveder
5,054,216 A 10/1991 Lin
5,090,140 A 2/1992 Sessa
5,152,082 A 10/1992 Culpepper
5,181,331 A 1/1993 Berger
5,184,410 A 2/1993 Hamilton
5,279,051 A * 1/1994 Whatley ..... A43B 13/181 36/114
5,282,327 A 2/1994 Ogle
5,317,819 A * 6/1994 Ellis, III ..... A43B 5/00 36/114
5,341,583 A 8/1994 Hallenbeck
5,371,957 A 12/1994 Gaudio
5,406,721 A 4/1995 Marcolin
5,467,537 A 11/1995 Aveni et al.
5,481,814 A 1/1996 Spencer
5,826,353 A 10/1998 Woznicki
5,842,292 A 12/1998 Siesel
5,926,978 A 7/1999 Smith
5,933,986 A 8/1999 Donnadieu
6,000,148 A 12/1999 Cretinon
6,189,239 B1 2/2001 Gasparovic et al.
6,298,582 B1 * 10/2001 Friton ..... A43B 23/027 36/102
6,314,662 B1 11/2001 Ellis, III
6,360,454 B1 3/2002 Dachgruber et al.
6,378,230 B1 4/2002 Rotem et al.
6,497,058 B2 12/2002 Dietrich et al.
6,557,271 B1 5/2003 Weaver, III
6,578,288 B2 6/2003 Bernstein
6,684,533 B1 2/2004 Su
6,874,255 B2 * 4/2005 Bernstein ..... A43B 3/103 36/106
6,880,272 B2 * 4/2005 Wells ..... A43B 11/02 36/105
6,925,732 B1 8/2005 Clarke
6,938,361 B2 9/2005 Su
7,082,702 B2 8/2006 Cretinon
7,103,994 B2 9/2006 Johnson
7,225,563 B2 6/2007 Chen et al.
7,392,603 B1 7/2008 Shepherd et al.
7,439,837 B2 10/2008 McDonald
7,685,747 B1 3/2010 Gasparovic et al.
7,793,438 B1 9/2010 Busse et al.
7,823,299 B1 11/2010 Brigham
7,975,403 B2 7/2011 Mosher
8,020,317 B1 9/2011 Sokolowski
D648,512 S 11/2011 Schlageter et al.
8,056,264 B2 11/2011 Sato et al.
8,065,819 B2 11/2011 Kaufman
8,161,669 B2 4/2012 Keating
8,245,421 B2 * 8/2012 Baudouin ..... A43B 11/00 36/103
8,769,845 B2 7/2014 Lin
9,192,204 B1 11/2015 Liles et al.
9,820,527 B2 11/2017 Pratt et al.
D840,663 S * 2/2019 Flanagan ..... A43B 11/00 D2/972
D854,303 S * 7/2019 Flanagan ..... A43B 11/00 D2/972
10,455,898 B1 10/2019 Orand et al.
10,617,174 B1 4/2020 Hopkins et al.
10,638,810 B1 5/2020 Cheney et al.
10,905,192 B1 2/2021 Cheney
11,191,321 B2 12/2021 Kilgore et al.
11,219,274 B2 1/2022 Orand et al.
11,344,077 B2 5/2022 Hopkins et al.
2002/0053147 A1 5/2002 Borsoi et al.
2002/0066213 A1 6/2002 Wells
2002/0092205 A1 7/2002 Hall et al.
2002/0112376 A1 8/2002 Tomat
2002/0144434 A1 10/2002 Farys et al.
2004/0088890 A1 5/2004 Matis et al.
2004/0111921 A1 6/2004 Lenormand
2004/0244226 A1 * 12/2004 Farys ..... A43B 7/20 36/140
2005/0039348 A1 2/2005 Raluy et al.
2005/0081404 A1 4/2005 Hurd et al.
2005/0198869 A1 9/2005 Bouche et al.
2006/0010718 A1 * 1/2006 Auger ..... A43B 23/088 36/69
2006/0032091 A1 2/2006 Kilgore
2007/0074425 A1 4/2007 Leong
2007/0256332 A1 11/2007 Calderone
2008/0083138 A1 4/2008 Lacorazza et al.
2008/0086911 A1 4/2008 Labbe
2008/0120871 A1 5/2008 Sato et al.
2008/0155788 A1 7/2008 Wilcox
2008/0307673 A1 12/2008 Johnson
2009/0100712 A1 4/2009 Baker et al.
2011/0016751 A1 1/2011 Somerville
2011/0119959 A1 5/2011 Bodner
2011/0146106 A1 6/2011 Kaufman
2011/0185592 A1 8/2011 Nishiwaki et al.
2011/0308109 A1 * 12/2011 Sokolowski ..... A43B 23/17 36/69
2012/0079742 A1 4/2012 Ferreira et al.
2012/0180338 A1 7/2012 Lin
2012/0192453 A1 8/2012 Raysse et al.
2012/0198721 A1 8/2012 Cavaliere
2012/0297643 A1 11/2012 Shaffer et al.
2012/0304491 A1 12/2012 Kimura et al.
2012/0317839 A1 12/2012 Pratt
2013/0185959 A1 7/2013 Coleman
2013/0219747 A1 8/2013 Lederer
2013/0247416 A1 9/2013 Nurse et al.
2014/0130376 A1 5/2014 Fahmi et al.
2014/0137434 A1 5/2014 Craig
2014/0150292 A1 6/2014 Podhajny et al.
2014/0173935 A1 6/2014 Sabbioni
2014/0202044 A1 7/2014 Adami et al.
2014/0305005 A1 * 10/2014 Yeh ..... A43B 7/143 36/69
2015/0237960 A1 8/2015 Mallen et al.
2015/0305432 A1 10/2015 Wiens
2016/0007687 A1 1/2016 Surace et al.
2016/0029743 A1 * 2/2016 Cavaliere ..... A43B 5/00 36/105
2016/0088899 A1 3/2016 Liles et al.
2016/0302530 A1 10/2016 Smith et al.
2016/0324269 A1 * 11/2016 Dombrow ..... A43B 7/085
2016/0332063 A1 11/2016 Van Horne

(56) References Cited

U.S. PATENT DOCUMENTS

| | | | | |
|---|---|---|---|---|
| 2016/0374427 | A1* | 12/2016 | Zahabian | A43B 3/24 36/102 |
| 2017/0055630 | A1 | 3/2017 | Marshall | |
| 2017/0099908 | A1 | 4/2017 | Lee et al. | |
| 2017/0105485 | A1* | 4/2017 | Schenone | A43B 23/088 |
| 2017/0231319 | A1* | 8/2017 | Bohnsack | A43B 7/28 36/92 |
| 2017/0303632 | A1* | 10/2017 | Pratt | A43B 23/26 |
| 2017/0360143 | A1 | 12/2017 | Pratt et al. | |
| 2017/0360151 | A1 | 12/2017 | Pratt | |
| 2017/0370027 | A1 | 12/2017 | Da Costa Pereira Machado et al. | |
| 2018/0098601 | A1 | 4/2018 | Hartenstein et al. | |
| 2018/0110287 | A1* | 4/2018 | Hopkins | A43B 23/0245 |
| 2018/0110292 | A1 | 4/2018 | Beers et al. | |
| 2018/0206588 | A1 | 7/2018 | Pratt et al. | |
| 2018/0213882 | A1* | 8/2018 | Morse | A43B 11/00 |
| 2018/0279721 | A1 | 10/2018 | Doenges | |
| 2018/0289109 | A1 | 10/2018 | Beers et al. | |
| 2018/0338583 | A1 | 11/2018 | Sullivan | |
| 2019/0045884 | A1* | 2/2019 | Uda | A43B 13/37 |
| 2019/0297999 | A1* | 10/2019 | Nakaya | A43B 13/41 |
| 2020/0000178 | A1* | 1/2020 | Pratt | A43C 11/008 |
| 2020/0196703 | A1 | 6/2020 | Hopkins | |
| 2020/0205511 | A1 | 7/2020 | Hopkins et al. | |
| 2020/0205518 | A1 | 7/2020 | Hopkins et al. | |
| 2020/0205520 | A1 | 7/2020 | Kilgore | |
| 2020/0229536 | A1 | 7/2020 | Hopkins et al. | |
| 2020/0253333 | A1* | 8/2020 | Kilgore | A43B 23/088 |
| 2020/0390183 | A1* | 12/2020 | Arnold | A43B 3/122 |
| 2021/0068494 | A1* | 3/2021 | Zahabian | A43B 11/00 |
| 2021/0106094 | A1* | 4/2021 | Cheney | A43B 3/246 |
| 2021/0112914 | A1* | 4/2021 | Cheney | A43B 23/0275 |
| 2021/0112916 | A1* | 4/2021 | Schulten | A43B 13/37 |
| 2021/0204643 | A1 | 7/2021 | Kyle | |
| 2021/0204644 | A1* | 7/2021 | Kyle | A43B 3/16 |
| 2021/0378356 | A1 | 12/2021 | Cheney et al. | |

FOREIGN PATENT DOCUMENTS

| | | | |
|---|---|---|---|
| CN | 1403041 | A | 3/2003 |
| CN | 1832693 | A | 9/2006 |
| CN | 1993064 | A | 7/2007 |
| CN | 101022744 | A | 8/2007 |
| CN | 201005111 | Y | 1/2008 |
| CN | 101480282 | A | 7/2009 |
| CN | 101991227 | A | 3/2011 |
| CN | 101991227 | B | 8/2012 |
| CN | 102762121 | A | 10/2012 |
| CN | 103313622 | A | 9/2013 |
| CN | 104203024 | A | 12/2014 |
| CN | 204317632 | U | 5/2015 |
| CN | 105163616 | A | 12/2015 |
| CN | 105611851 | A | 5/2016 |
| CN | 205568021 | U | 9/2016 |
| CN | 108697196 | A | 10/2018 |
| DE | 3928625 | A1 | 3/1991 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| EP | 0149362 | A2 | 7/1985 |
| EP | 1059044 | A1 | 12/2000 |
| EP | 2319344 | A1 | 5/2011 |
| EP | 2438826 | A1 | 4/2012 |
| FR | 1083503 | | 1/1955 |
| FR | 1474203 | A | 3/1967 |
| GB | 503525 | | 4/1939 |
| GB | 2517148 | A | 2/2015 |
| GB | 2517399 | A | 2/2015 |
| JP | 50-11740 | U | 2/1975 |
| JP | 56-158803 | U | 11/1981 |
| JP | 57-72603 | A | 5/1982 |
| JP | 1-80010 | U | 5/1989 |
| JP | 1-81910 | U | 6/1989 |
| JP | 1-179511 | U | 12/1989 |
| JP | 2000-139502 | A | 5/2000 |
| JP | 2000-184902 | A | 7/2000 |
| JP | 2001-149394 | A | 6/2001 |
| JP | 2005-46520 | A | 2/2005 |
| JP | 2005-532115 | A | 10/2005 |
| JP | 2006-055571 | A | 3/2006 |
| JP | 2012-61046 | A | 3/2012 |
| JP | 2012-110687 | A | 6/2012 |
| KR | 20090130804 | A | 12/2009 |
| NL | 2000762 | C1 | 1/2009 |
| TW | 200743450 | A | 12/2007 |
| WO | 90/00358 | A1 | 1/1990 |
| WO | 2007/080205 | A1 | 7/2007 |
| WO | 2009/154350 | A1 | 12/2009 |
| WO | WO-2009154350 | A1 * | 12/2009 ..... A43B 11/02 |
| WO | 2010/059716 | A2 | 5/2010 |
| WO | 2015/183486 | A1 | 12/2015 |
| WO | 2016/002412 | A1 | 1/2016 |
| WO | 2017/090195 | A1 | 6/2017 |

OTHER PUBLICATIONS

Notice of Allowance received for U.S. Appl. No. 16/230,912, dated Sep. 15, 2020, 8 pages.

Non-Final Office Action received for U.S. Appl. No. 16/725,860, dated Apr. 12, 2021, 9 pages.

Final Office Action received for U.S. Appl. No. 16/230,912, dated Jun. 17, 2020, 19 pages.

International Search Report and Written Opinion received for PCT Patent Application No. PCT/US2019/067599, dated Jun. 25, 2020, 15 pages.

International Preliminary Report on Pantentability received for PCT Patent Application No. PCT/US2019/067590, dated Jul. 8, 2021, 8 pages.

International Preliminary Report on Pantentability received for PCT Patent Application No. PCT/US2019/067592, dated Jul. 1, 2021, 9 pages.

International Preliminary Report on Pantentability received for PCT Patent Application No. PCT/US2019/068651, dated Jul. 8, 2021, 7 pages.

International Preliminary Report on Pantentability received for PCT Patent Application No. PCT/US2019/068686, dated Jul. 8, 2021, 10 pages.

International Preliminary Report on Patentability received for PCT Patent Application No. PCT/US2019/067595, dated Jul. 1, 2021, 8 pages.

International Preliminary Report on Patentability received for PCT Patent Application No. PCT/US2019/067599, dated Jul. 1, 2021, 10 pages.

Non-Final Office Action received for U.S. Appl. No. 16/662,628, dated Jun. 16, 2021, 6 pages.

Final Office Action received for U.S. Appl. No. 16/725,860, dated Jul. 26, 2021, 7 pages.

Notice of Allowance received for U.S. Appl. No. 16/662,628, dated Jul. 29, 2021, 5 pages.

Two Piece Snap Rivets, ITW Fastex, Plastic Fasteners Catalog, Available online at: <http://www.itw-fastex.com/catalog/index.php/dw/op/a/6/c/14/p/27?m=no#specs>, Downloaded on Feb. 18, 2020, pp. 1-2.

Non-Final Office Action received for U.S. Appl. No. 16/725,860, dated Oct. 22, 2021, 5 pages.

Office Action received for European Patent Application No. 19836920.9, dated Mar. 28, 2022, 7 pages.

Office Action received for European Patent Application No. 19839789.5, dated Mar. 30, 2022, 7 pages.

Office Action received for European Patent Application No. 19842673.6, dated Mar. 15, 2022, 5 pages.

Non-Final Office Action received for U.S. Appl. No. 16/725,754, dated Feb. 4, 2022, 15 pages.

Non-Final Office Action received for U.S. Appl. No. 16/894,266, dated Jan. 5, 2022, 10 pages.

(56) References Cited

OTHER PUBLICATIONS

Notice of Allowance received for U.S. Appl. No. 16/725,860, dated Feb. 8, 2022, 7 pages.
Notice of Allowance received for U.S. Appl. No. 16/894,266, dated May 23, 2022, 8 pages.
Intention to Grant received for European Patent Application No. 19842490.5, dated Apr. 12, 2022, 6 pages.
Final Office Action received for U.S. Appl. No. 16/725,754, dated Aug. 16, 2022, 24 pages.
Non-Final Office Action received for U.S. Appl. No. 17/135,220, dated Aug. 2, 2022, 21 pages.
Office Action received for European Patent Application No. 19842673.6, dated Jul. 22, 2022, 7 pages.
Office action received for European Patent Application No. 19839789.5, dated Sep. 6, 2022, 8 pages.
Partial European Search Report received for European Application No. 22191953.3, dated Sep. 29, 2022, 11 pages.
Office Action received for European Patent Application No. 19839789.5, dated Mar. 9, 2023, 5 pages.
Non-Final Office Action received for U.S. Appl. No. 17/950,814, dated Dec. 27, 2022, 10 pages.
Non-Final Office Action received for U.S. Appl. No. 17/950,798, dated Dec. 16, 2022, 8 pages.
Non-Final Office Action received for U.S. Appl. No. 17/950,781, dated Dec. 14, 2022, 9 Pages.
Extended European Search Report received for European Application No. 22191953.3, dated Jan. 9, 2023, 10 pages.
Intention to Grant received for European Patent Application No. 19836920.9, dated Oct. 28, 2022, 6 pages.
Office Action received for European Patent Application No. 19842673.6, dated Feb. 7, 2023, 6 pages.
Final Office Action received for U.S. Appl. No. 17/135,220, dated Jan. 25, 2023, 22 pages.
Notice of Allowance received for U.S. Appl. No. 17/482,809, dated Feb. 1, 2023, 5 pages.
Non-Final Office Action received for U.S. Appl. No. 17/482,809, dated Nov. 22, 2022, 5 pages.
Non-Final Office Action received for U.S. Appl. No. 17/950,814, dated Apr. 6, 2023, 8 pages.
Non-Final Office Action received for U.S. Patent Application No. 17/750,193, dated Apr. 7, 2023, 8 pages.
Notice of Allowance received for U.S. Appl. No. 17/950,781, dated Mar. 29, 2023, 7 pages.
Notice of Allowance received for U.S. Appl. No. 17/950,798, dated Mar. 27, 2023, 7 pages.
Solereview Inc, "Nike Lunarglide 7 Review": Online publication at https://www.solereview.com/nike-lunarglide-7-review/. —Last Visited on Apr. 18, 2023.
Non-Final Office Action received for U.S. Appl. No. 17/950,781, dated May 16, 2023, 5 pages.
Extended European Search Report received for European Patent Application No. 23159696.6, dated May 25, 2023, 13 pages.
Intention to Grant received for European Patent Application No. 19842673.6 dated Jun. 9, 2023, 7 pages.
Notice of Allowance received for U.S Appl. No. 17/750,193, dated Jul. 19, 2023, 5 pages.
Non-Final Office Action received for U.S. Appl. No. 17/950,857, dated Jun. 20, 2023, 13 pages.

* cited by examiner

ANTERIOR

POSTERIOR

FOOTWEAR ARTICLE WITH COLLAR ELEVATOR

CROSS-REFERENCE TO RELATED APPLICATIONS

This application is a continuation of U.S. application Ser. No. 16/230,907 (filed on Dec. 21, 2018, and issuing as U.S. Pat. No. 10,617,174), which is incorporated herein by reference in its entirety.

TECHNICAL FIELD

This disclosure relates to a footwear article having a collar elevator for raising an ankle collar from a lowered state to a raised state.

BACKGROUND

Some footwear articles include an ankle collar that is manipulated when the footwear article is put on. For example, the ankle collar may be depressed towards the sole as the wearer's foot is slid into the upper. Furthermore, some of these footwear articles include a collar elevator operable to move the ankle collar from the depressed or lowered state to the raised state. An example of one type of collar elevator is described in U.S. Pat. No. 9,820,527, and examples of other collar elevators are described in US Pat. Pub. 2018/0110292 and US Pat. Pub. 2018/0289109.

BRIEF DESCRIPTION OF THE DRAWINGS

Some subject matter described in this disclosure makes reference to drawing figures, which are incorporated herein by reference in their entirety.

DETAILED DESCRIPTION

Figure 1:
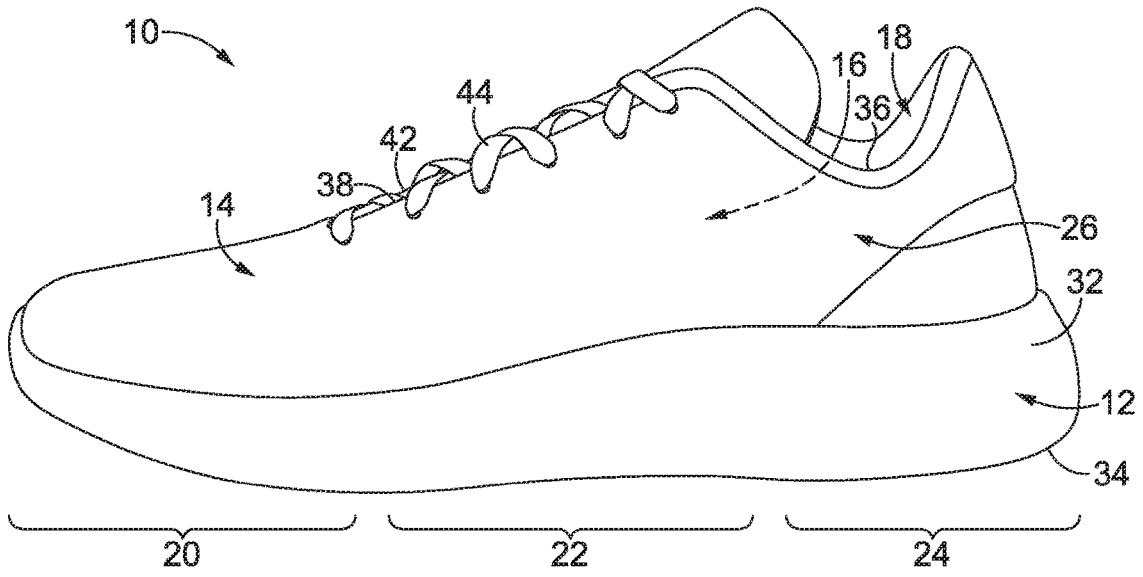
FIG. 1 depicts a side view of a footwear article in accordance with an aspect of this disclosure.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to, among other things, a footwear article having a doffing ledge, including manufactures, machines, and methods associated therewith. In some aspects, the doffing ledge may provide a lever for pressing the footwear article in one direction, while the wearer slides his or her heel out of the footwear article in a different direction. Some aspects of this disclosure are directed to a footwear article with a doffing ledge and a collar elevator.

Before describing the figures in more detail, some additional explanation will now be provided related to certain terminology that may be used in this disclosure.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the invention, as defined by the claims.

The term "longitudinal," as possibly used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse," as possibly used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical," as possibly used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component, and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as a shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

Figure 2:
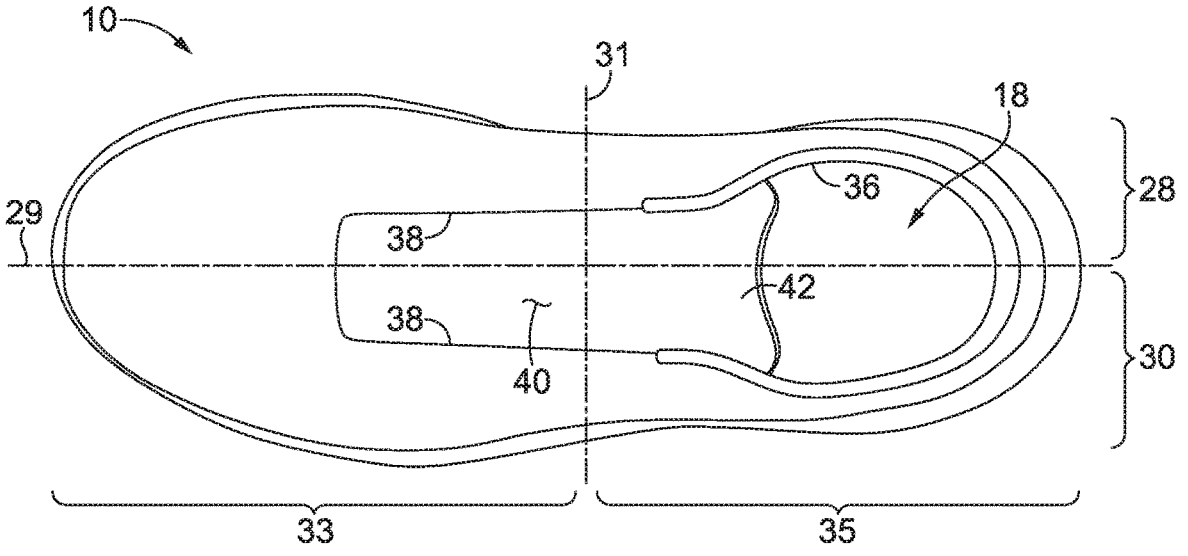
FIG. 2 depicts a top view of the footwear article of FIG. 1 in accordance with an aspect of this disclosure.

In order to aid in the explanation of, and understanding of, aspects of this Specification, reference is now made to FIGS. 1 and 2 to describe elements of a typical footwear article 10, which may include a tongue reinforcer. FIG. 1 depicts a lateral side of the footwear article 10, and FIG. 2 depicts a top of the footwear article. When describing the various figures mentioned in this disclosure, like reference numbers refer to like components throughout the views.

The footwear article 10 includes at least two primary elements including a sole structure 12 and an upper 14. When the footwear article 10 is worn (as intended on a foot), the sole structure 12 is typically positioned near the foot plantar surface (i.e., the bottom of the foot). The sole structure 12 may protect the bottom of the foot, and in addition, may attenuate ground-reaction forces, absorb energy, provide traction, and control foot motion, such as pronation and supination. The upper 14 is coupled to the sole structure 12, and together with the sole structure 12, forms a foot-receiving cavity 16. That is, while the sole structure 12 typically encloses the bottom of the foot, the upper 14 extends over, and at least partially covers, a dorsal portion of the foot (i.e., the top of the foot or the instep) and secures the footwear article 10 to the foot. The upper 14 includes a foot-insertion opening 18, through which a foot is inserted when the footwear article 10 is put on as the foot is arranged into the foot-receiving cavity 16.

As indicated in FIG. 1, the footwear article 10 may include a forefoot region 20, a midfoot region 22, a heel region 24, and an ankle region 26. The forefoot region 20, the midfoot region 22, and the heel region 24 extend through the sole structure 12 and the upper 14. The ankle region 26 is located in a portion of the upper 14. The forefoot region 20 generally includes portions of the footwear article 10 corresponding with the toes and the joints connecting the metatarsals with the phalanges. The midfoot region 22 generally includes portions of the footwear article 10 corresponding with the arch area and instep of the foot. The heel region 24 corresponds with rear portions of the foot, including the calcaneus bone. The ankle region 26 corresponds with the ankle. The forefoot region 20, the midfoot region 22, the heel region 24, and the ankle region 26 are not intended to demarcate precise areas of the footwear article 10, and are instead intended to represent general areas of the footwear article 10 to aid in the understanding of various aspects of this Specification. In addition, portions of a footwear article may be described in relative terms using these general zones. For example, a first structure may be described as being more heelward than a second structure, in which case the second structure would be more toeward and closer to the forefoot.

The footwear article 10 also has a medial side 28 (identified in FIG. 2 and obscured from view in FIG. 1) and a lateral side 30 (identified in FIG. 2 and viewable in FIG. 1). The medial side 28 and the lateral side 30 extend through each of the forefoot region 20, the midfoot region 22, the heel region 24, and the ankle region 26, and correspond with opposite sides of the footwear article 10, each falling on an opposite side of a longitudinal midline reference plane 29 of the footwear article 10, as is understood by those skilled in the art. For example, the longitudinal midline reference plane 29 may pass through the foremost point of the sole structure and the rearmost point of the sole structure. The medial side 28 is thus considered opposite to the lateral side 30. Typically, the lateral side corresponds with an outside area of the foot (i.e., the surface that faces away from the other foot), and the medial side corresponds with an inside area of the foot (i.e., the surface that faces toward the other foot). In another aspect, the footwear article includes an anterior portion 33 and a posterior portion 35, falling on an opposite side of a latitudinal midline reference plane 31 of the footwear article 10. The latitudinal midline reference plane 31 extends perpendicular to the longitudinal midline reference plane 29 and to the ground-surface plane and is spaced evenly between the foremost point of the footwear article 10 and the rearmost point of the footwear article 10. In addition, these terms may also be used to describe relative positions of different structures. For example, a first structure that is closer to the inside portion of the footwear article might be described as medial to a second structure, which is closer to the outside area and is more lateral.

In describing a footwear article, the relative terms "inferior" and "superior" may also be used. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface.

The sole structure 12 may be constructed of various materials and may include various elements. For example, the sole structure 12 may include a midsole 32 and an outsole 34. The midsole 32 may be formed from a compressible polymer foam element (e.g., a polyurethane or ethylvinylacetate (EVA) foam) that attenuates ground reaction forces (i.e., provides cushioning) when compressed between the foot and the ground during walking, running, or other ambulatory activities. In further aspects, the midsole 32 may incorporate fluid-filled chambers, plates, moderators, or other elements that further attenuate forces, enhance stability, or influence motions of the foot. The midsole 32 may be a single, one-piece midsole, or could be multiple components integrated as a unit. In some aspects, the midsole 32 may be integrated with the outsole 34 as a unisole. The outsole 34 may be one-piece, or may be several outsole components, and may be formed from a wear-resistant rubber material that may be textured to impart traction and/or may include traction elements such as tread or cleats secured to the midsole 32. The outsole 34 may extend either the entire length and width of the sole or only partially across the length and/or width.

The upper 14 may also be constructed of various materials and may include various features. For example, the upper 14 may be constructed of leather, textiles, or other synthetic or natural materials. Further, the upper 14 may be a knit textile, woven, braided, non-woven, laminate, or any combination thereof. The upper 14 may have various material properties related to breathability, stretch, flexibility, wicking, water resistance, and the like.

The upper 14 typically includes a portion that overlaps with, and is connected to, the sole structure 12, and the junction of this connection may be referred to as a biteline. In addition, the upper 14 may include a "strobel," which includes a material panel extending from the upper 14 and across at least a portion of a foot-facing surface of the sole structure 12, and the strobel may be used to hold the upper 14 on a last when the sole structure 12 is attached to the upper 14. Stated differently, the sole structure 12 that is integrated into the footwear article 10 includes a foot-facing surface, and in some instances, the upper 14 may include a panel (referred to as a strobel) that extends inward from near the biteline region and at least partially covers the foot-facing surface. In that instance, the strobel is positioned underneath a foot when the footwear article is worn. The strobel may be covered by an insole or other layer of material.

The upper 14 includes other features. For example, the upper 14 includes an ankle collar 36 that forms a perimeter around at least a portion of the foot-insertion opening 18. In addition, the upper 14 includes a throat 38 that often extends from the ankle collar 36 and forms a perimeter along at least one or more sides of an elongated opening 40. A tongue 42 is located in the elongated opening 40, and a size of the elongated opening 40 can be adjusted using various closure systems. For example, FIG. 1 illustrates laces 44, and other closure systems may include elastic bands, hook-and-loop straps, zippers, buckles, and the like. The position of the tongue 42 and the connections of the closure system can be adjusted to vary a size of the foot-insertion opening and the elongated opening, such as by making the openings larger when the footwear article is being donned or doffed and by making the openings smaller when the footwear article is being secured onto a foot. As will be described in other portions of this disclosure, the tongue 42 might include a tongue reinforcer, which might help the tongue maintain a shape and position when the tongue is subjected to forces or adjustments, such as from other footwear-article elements or from a wearer.

The footwear article 10 might include an athletic-type shoe, such as might be worn when running or walking, and the description of the footwear article 10, including the elements described with respect to FIGS. 1 and 2, might also be applicable to other types of shoes, such as basketball shoes, tennis shoes, American football shoes, soccer shoes, leisure or casual shoes, dress shoes, work shoes, a sandal, a slipper, a boot, hiking shoes, and the like.

Figure 3A:
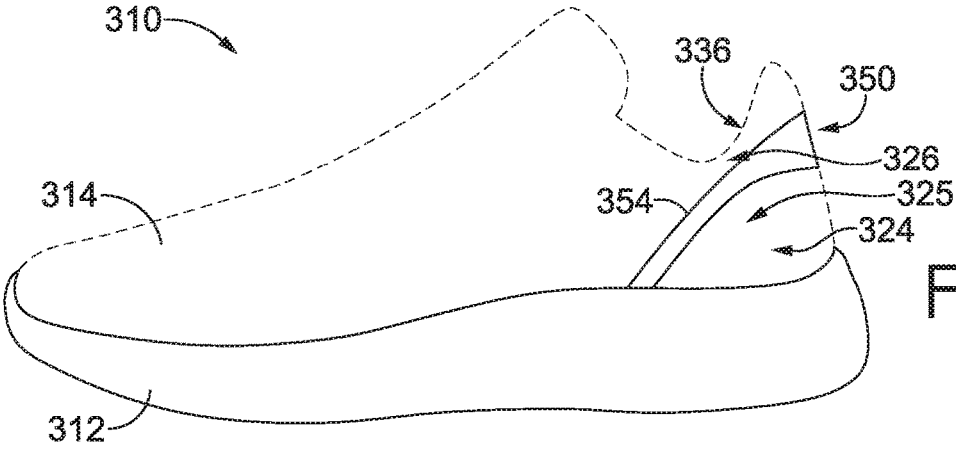
FIGS. 3A-3C depict another footwear article having a collar elevator in accordance with an aspect of this disclosure.
Figure 3B:
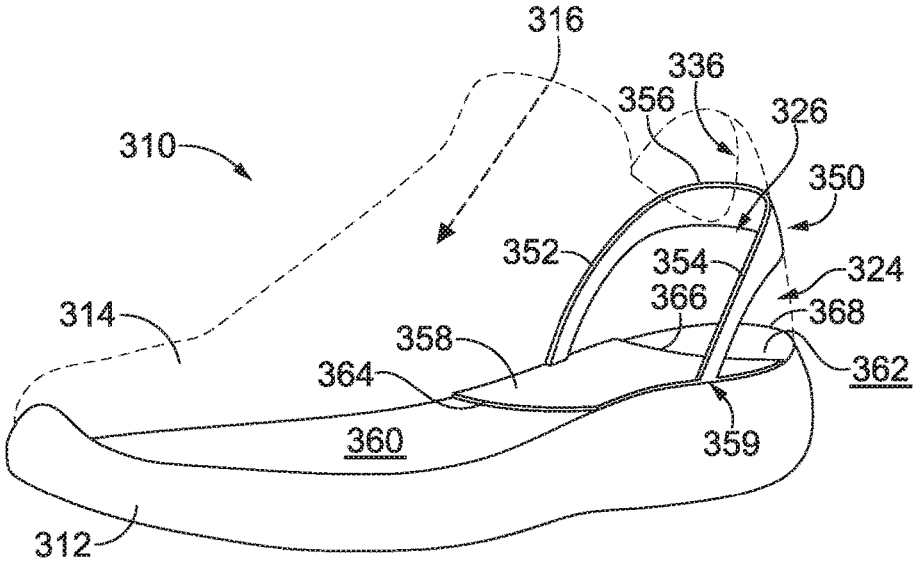
Figure 3C:
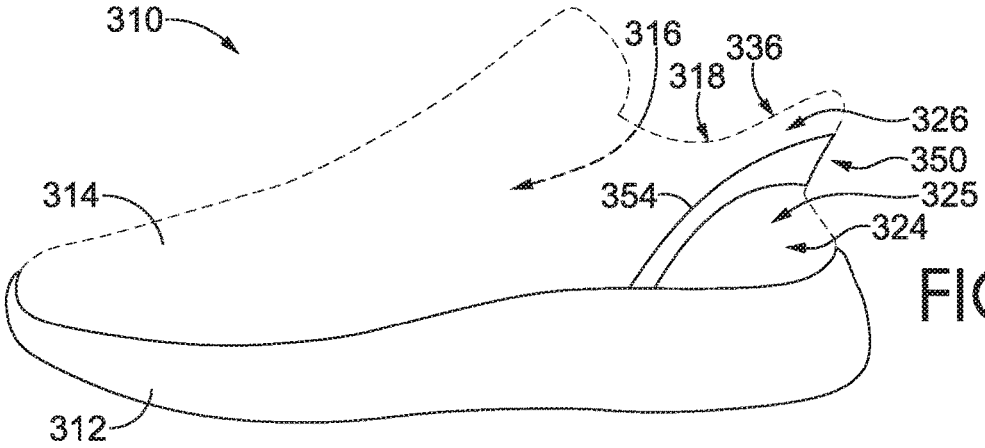

Having described FIGS. 1 and 2, reference is now made to FIGS. 3A-3C and 4A-4C to describe some other aspects of this disclosure. Each of FIGS. 3A, 3B, and 3C depicts a footwear article 310, which includes an upper 314 coupled to a sole 312, and the upper 314 includes a heel region 324 and an ankle region 326 with an ankle collar 336. The ankle collar 336 is movable between a lowered state (as depicted in FIG. 3C) and a raised state (as depicted in FIGS. 3A and 3B). In the lowered state, the ankle collar 336 is positioned closer to the sole 312, and in the raised state, the ankle collar 336 is positioned farther from the sole 312. Similarly, the footwear article 410 includes an upper 414 coupled to a sole 412, and the upper 414 includes a heel region 424 and an ankle region 426 with an ankle collar 436.

Figure 4A:
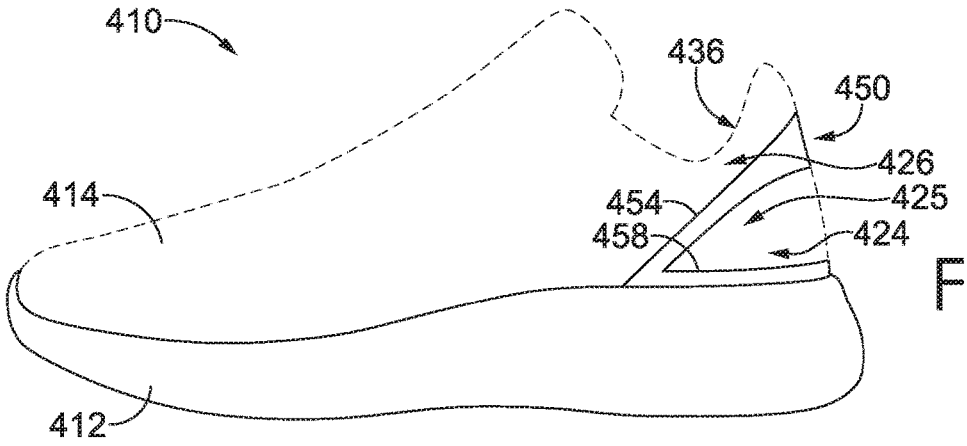
FIGS. 4A-4C depict another footwear article having an alternative collar elevator in accordance with an aspect of this disclosure.
Figure 4B:
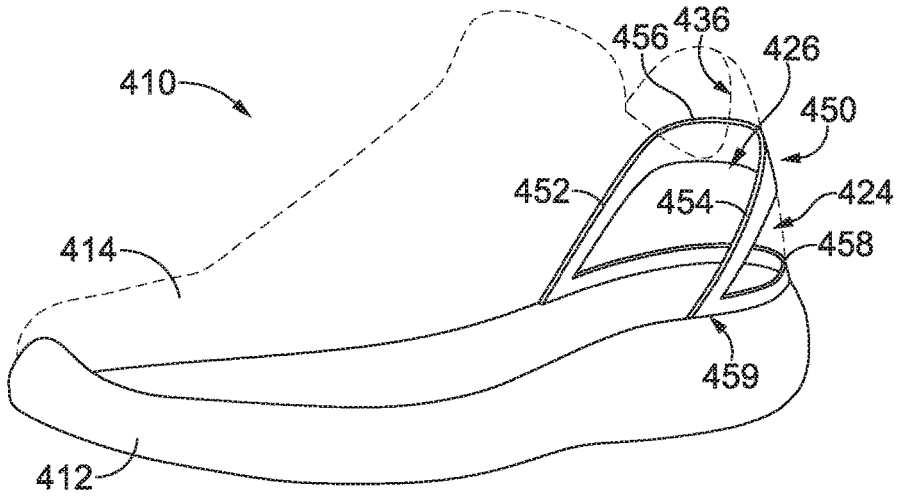
Figure 4C:
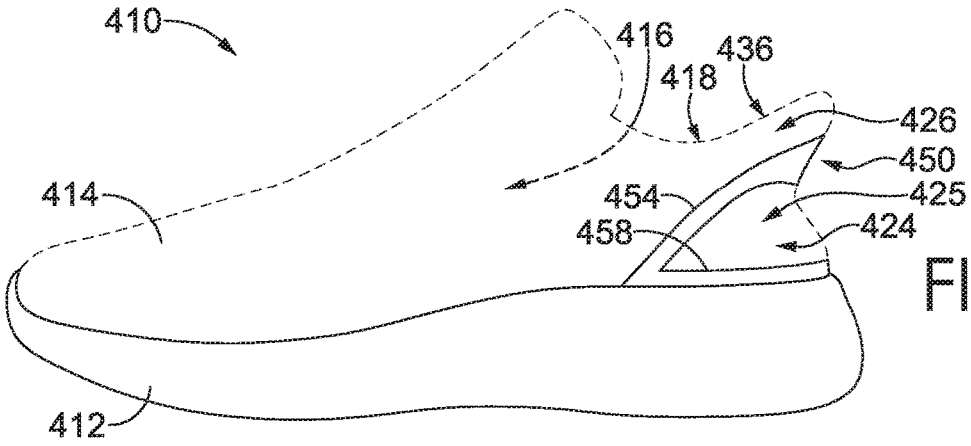

Furthermore, the footwear article 310 includes a collar elevator 350 that is coupled to the upper 314 near the heel region 324 and/or the ankle region 326 and that is operable to move the ankle collar 336 from the lowered state to the raised state. More specifically, the collar elevator 350 includes portions that are positioned in the heel region 324 and that extend up into the ankle region 326. As previously, indicated, there are not necessarily precise delineations between the heel region 324 and the ankle region 326; rather, describing the positioning of the collar elevator 350 with respect to these regions is one way to describe that the collar elevator 350 extends from a more inferior part closer to the sole to a more superior part closer to the ankle collar 336. As far as the coupling of the collar elevator 350 to the upper 314 near the heel region 324 and/or near the ankle region 326, this coupling may take various forms. For example, the collar elevator 350 may be coupled to the upper in the heel region 324, in the ankle region 326, to the ankle collar 336, or any and all combinations thereof. The collar elevator 350 is an example of one type of collar elevator operable to move an ankle collar from the lowered state to the raised state, and as will be described in other portions of this disclosure, a collar elevator may include one or more alternative structures than those depicted in FIGS. 3A-3C. For example, FIGS. 4A-4C depict a footwear article 410 with a collar elevator 450 that is operable to move the ankle collar 436 from the lowered state (e.g., FIG. 4C) to the raised state (e.g., FIGS. 4A and 4B) and that has a different structure from the collar elevator 350.

For illustrative purposes, the upper 314 and the upper 414 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

A collar elevator (such as the collar elevators 350 and 450) may include various elements. In one aspect, a collar elevator includes a medial lever arm, a lateral lever arm, and a center connecting band that couples the medial lever arm to the lateral lever arm and that is located in a heel portion of the ankle collar. In a further aspect, each lever arm is affixed to a base, which remains stationary relative to the lever arms as the lever arms deform when the ankle collar is moved to a lowered state. The base may be a portion of the footwear article, such as a portion of the sole or a portion of the upper. In addition, the base may be one or more other anchors affixed directly or indirectly to the sole, the sole itself, or any combination thereof. U.S. Pat. No. 9,820,527 describes one or more collar elevators, some of which may be referred to as a deformable member or as deformable members (with or without a base), and the full disclosure of U.S. Pat. No. 9,820,527 is incorporated herein by reference in its entirety. In accordance with an aspect of this disclosure, at least some of the deformable members described in U.S. Pat. No. 9,820,527 include a medial lever arm, a lateral lever arm, and a center connecting band that couples the medial lever arm to the lateral lever arm. In other examples, US 2018/0110292 and US 2018/0289109 each describes a plurality of other collar elevators, some of which are referred to as a control bar (with or without a base), and the full disclosures of US 2018/0110292 and US 2018/0289109 are incorporated herein by reference in their entirety. In accordance with an aspect of this disclosure, at least some of the control bars described in US 2018/0110292 and US 2018/0289109 include a medial lever arm, a lateral lever arm, and a center connecting band that couples the medial lever arm to the lateral lever arm.

Each of the illustrated collar elevators 350 and 450 depicts examples of medial lever arms 352 and 452, respectively. In addition, each of the illustrated collar elevators 350 and 450 depicts examples of lateral lever arms 354 and 454, respectively, and center connecting bands 356 and 456, respectively. Furthermore, the lever arms 352 and 354 attach to a base 358, and the lever arms 452 and 454 attach to a base 458 having a different structure from the base 358. The base 358 is affixed to or near a foot-facing surface of the sole 312, and the base 358 might be a portion of an outsole, a portion of a midsole, a portion of an insole, a portion of a strobel, a plate or sheet of material layered between any of these sole layers, or any combination thereof. Among other things, the base 358 might include a rigid portion or section to which the lever arms 352 and 354 are anchored. As depicted in FIG. 3B, the base 358 partially covers a superior surface of the sole 312, and the superior surface faces towards the foot-receiving cavity 316. In some aspects, the sole 312 includes a midsole, such that the superior surface is of the midsole and the base 358 is layered between the midsole and an insole. In FIG. 3B, a surface forefoot portion 360 and a surface heel portion 362 are identified, both of which are not covered by the base 358. The base 358 includes a forward anterior edge 364 and a rearward posterior edge 366, both of which extend from the medial side to the lateral side of the footwear article 310. The rearward posterior edge 366 is positioned closer to a rearmost point 368 of the surface heel portion 362 (as compared to the forward anterior edge 364) and is also spaced forward of the rearmost point 368. As such, the base 358 does not extend entirely to the rearmost point 368, and the surface heel portion 362 (extending from the rearward posterior edge 366 to the rearmost point 368) is not covered by the base 358. In some instances the base 358 may be more rigid than the sole 312. As such, the uncovered surface heel portion 362 may provide for a more cushioned heel strike for a wearer (compared to versions in which the base extends further rearward to near the rearmost point 368), since the base 358 might not be directly under portions of the wearer's heel upon initial ground impact. FIGS. 4A-4C depict a different aspect, in which the base 458 might attach to a portion of the upper (e.g., a heel counter), a portion of the midsole sidewall, or any combination thereof, and the base 458 wraps around a backside of the footwear article, as opposed to extending through the footbed in the manner described with respect to the base 358.

The medial lever arm, the lateral lever arm, and the center connecting band may be a single continuous body, such that clear demarcation may not exist between the medial lever arm, the lateral lever arm, and the center connecting band. For example, the medial and lateral arms and the center connecting band may be molded, cast, 3D printed, or otherwise formed as a single, integrally formed unit. In other aspects, the medial lever arm and the lateral lever arm may be discrete, separate, and distinct elongated members, which are connected to the center connecting band, such as by a mechanical or chemical coupling, a friction fit, sheathing, or other coupling.

Having generally described some of the structural elements of a collar elevator, some operational aspects of a collar elevator will now be described. As briefly described above, the collar elevator moves the ankle collar from the lowered state to the raised state. More specifically, at least a portion of the medial lever arm, the lateral lever arm, the center connecting band, or any combination thereof, is affixed to a portion of the upper. In one aspect, the center connecting band may be affixed near a heel portion of the ankle collar. For example, as described in other portions of this disclosure, the center connecting band may be attached to the heel portion of the ankle collar by an adhesive, connection tab, heat stake, stitch, and the like. As such, when the ankle collar is moved to a lowered state closer to the sole, the medial lever arm and the lateral lever arm deform to a more compressed or more loaded position. Stated differently, the collar elevator stores potential energy by elastically deforming from a less compressed configuration (e.g., FIGS. 3A and 4A) to a more compressed configuration (e.g., FIGS. 3C and 4C) when an applied force moves the ankle collar from the raised state to the lowered state. The potential energy returns the collar elevator to the less compressed configuration upon removal of the applied force, and since the collar elevator is affixed to the upper, the ankle collar is also moved from the lowered state to the raised state. While the compression of the collar elevator may be greater when the ankle collar is moved to the lowered state (as compared with the raised state), in the raised state the collar elevator may still store potential energy in an at least partially deformed state (i.e., preloaded compression) so as to be able to hold a rear, heel portion of the ankle collar about the heel of the wearer. For example, if the collar elevator is attached to the upper heel region and/or the upper ankle region, then portions of the upper may hold or retain the collar elevator in the preloaded configuration when the ankle collar is in the raised state. In other aspects, the collar elevator may be unloaded when the ankle collar is in the raised state.

In one aspect, the portion 325 or 425 of the upper below the center connecting band may include wall of one or more textiles that are more flexible than other portions of the upper. This more flexible region of the upper may, for example, be at least partially in the heel-counter region. Among other things, this more flexible portion 325 or 425 of the upper may collapse more easily when the ankle collar is moved to a lower state and may provide less resistance for the collar elevator (as compared with a less flexible upper in other parts of the footwear article or in a typical footwear article) when the collar elevator is returning to the less compressed state.

In some aspects, the combination of the medial lever arm, the lateral lever arm, and the center connecting band may be referred to as a deformable element. The term "deformable element" refers to a resiliently flexible member that can be bent or compressed but has a bias to move towards a non-bent or uncompressed state. The deformable element may include a single, integrally formed, deformable element, extending continuously from the medial lever arm to the lateral lever arm. In other aspects, the medial lever arm and the lateral lever arm may be two or more separate and distinct deformable elements that connect to the center connecting band, which may also be referred to as a heel piece.

In some aspects, the deformable element might be directly coupled, mounted, or attached to the base. In other aspects, the base may include one or more anchors that engage and retain the deformable element in place. For example, anchors may be located at a junction (e.g., 359 and 459) between the lever arms and the base. Such anchors might be integrally formed with, coupled to, and/or located within or between or outside of portions of the sole (e.g., insole, midsole, outsole). For example, an anchor may be disposed in a block, plate, or wedge layered among, on top, or beneath the sole. In some instances, a portion of the sole (e.g., midsole) might be carved or cut out to attach to or house an anchor. In another aspect, a base extending in the mediolateral orientation (e.g., base 358) includes an anchor-shaped receptacle into which an anchor engages by way of a resistance fit, compression fit, a snap fit, or via an interlocking mechanism/configuration. In other examples, the anchors may be integrally formed with, coupled to, and/or located within, between, or outside of portions of the upper. For example, anchors may be located in the upper, in a heel counter, or any combination thereof. A single anchor may extend a full width of the footwear article, or two anchors may be positioned on opposing sides of the footwear article (e.g., on the medial and lateral sides). The deformable member may attach to the base or to an anchor at an angle. For example, the deformable member might attach at a perpendicular angle to the base and then curve or arc rearwardly. In another aspect, the deformable member might attach at a forwardly inclining angle (i.e., upwards and forwards) or a rearwardly reclining angle (i.e., upwards and rearwards) before rearwardly arcing.

A connection between the deformable member and the base or the anchors may be described in various manners. For example, in one aspect, the deformable element does not pivot (i.e., is non-pivoting) about the base (e.g., about an insole, midsole, or outsole). Described differently, the deformable element may be non-rotatably coupled to the base. In various aspects, engagement between the deformable element and the base (or anchor) is free of play, meaning that there is little or no relative movement between the two components.

A deformable element may include one or more of a tube, a wire, a spring, a shape memory structure or material, and the like. Furthermore, a deformable element can include one or more materials such as carbon steel, stainless steel, titanium, nickel titanium (nitinol) and other metals and alloys (shape-memory or otherwise), polymers (shape-memory or otherwise), composite materials, foam materials, graphite, carbon fiber, fiberglass, TPC-ET, silicone, TPU, and polycarbonate. For example, a deformable element might include titanium or be a titanium wire. Also, one or more deformable elements might be made of a first material, e.g., titanium, and one or more additional deformable elements might be made of a second material, e.g., graphite.

In some aspects, the deformable element might include a single, unitary piece. For instance, a first end of the deformable element (e.g., an end of the medial lever arm) might be embedded in, or attached to, a medial anchor; a second end of the deformable element (e.g., an end of the lateral lever arm) might be embedded in or attached to a lateral anchor; and a middle portion of the deformable element (e.g., the center connecting band) might extend around the heel portion or ankle portion of the upper, or be embedded within some additional heel-piece structure.

In other aspects, the deformable element might include a plurality of separate and distinct components. For instance, a deformable element might include two separate components, with a first component (e.g., medial lever arm) having a first end embedded in or attached to a medial anchor and a second end embedded in or attached to the medial side of a heel piece or center connecting band. As such, a second component (e.g., lateral lever arm) might similarly include a first end embedded in or attached to a lateral anchor and a second end embedded in or attached to the lateral side of the heel piece or center connecting band. The plurality of separate and distinct components can be secured together, for example, with one or more of a tape wrap, woven encasing, overmold (e.g., TPU), heat shrink tube, and the like, each of which can provide different stabilities and strengths. For example, a deformable element might include one or more wires encased independently or encased together in a cover, sleeve, overmold, or heat shrink tube. The one or more wires can arch, bend, and sway and then return to an initial/normal state in order to help facilitate the elastic deformation of the deformable element.

A deformable element might have variable mechanical properties along its length and/or at distinct points along its length. Such variation might be provided by the deformable element (e.g., by a wire or bundle of two or more wires), by a securement surrounding all or a portion of the deformable element(s), or any combination thereof. For example, the deformable element and/or the securement might have a variable cross-section, a variable density, a variable material, and/or the like along its length. A variable cross-section, in turn, can be provided by variation in thickness or shape, or twisting of the deformable element otherwise having a constant thickness or shape along its length.

As briefly described above, a deformable element may include a cover, sleeve, overmold, or other suitable structure, which might protect other elements (e.g., wire, spring, etc.) of the deformable element and might control, guide, support and/or otherwise affect the flexure or compression of the deformable element. In some aspects, the cover, based on its material of manufacture, shape, geometry, etc., is configured to facilitate mechanical stress distribution by transferring mechanical bending/deforming forces from the deformable element (e.g., from the wire(s) or spring) to the cover to prevent, or at least inhibit, the deformable element from damage or breakage that may otherwise result from the concentrated and repeated mechanical stress experienced by the deformable element. For example, the cover may have dimensions that vary along its length, such as a funnel-like tapering shape, to help distribute stress and contribute to the dynamic flexing of the deformable element. In the event that the deformable element breaks, the cover might still provide at least some degree of bias, thereby still helping to move the ankle collar from the lowered position to the raised position. Further, the cover may provide additional padding and/or support to the deformable element and may prevent, or at least inhibit, a wearer from feeling the deformable element.

As briefly described above, the center connecting band may also be referred to as a heel piece. The center connecting band may be integrally formed with the medial and lateral lever arms, as a single, continuous unit. In other aspects, the center connecting band may be a separate piece that extends between, and bridges, the medial and lateral lever arms. Among other things, the center connecting band may provide a coupling to the upper and may provide a frame to the ankle collar, to inhibit the ankle collar from collapsing into the foot-receiving opening when a foot is being inserted.

When being put on by a wearer, a footwear article with a collar elevator (e.g., collar elevators 350 and 450) might be slipped on by the wearer without the wearer using his or her hands to manipulate the footwear article. For example, the wearer's toes may be inserted through the foot-insertion openings 318 or 418, while the arch or heel of his or her foot is used to press downward on the ankle collars 336 or 436 towards the soles 312 or 412. This adjustment of the ankle collar 336 or 436 into the lowered state closer to the sole may increase a size of the foot-insertion opening 318 or 418. Once the wearer's foot has been slid into the foot-receiving cavity 316 or 416, the collar elevator 350 or 450 moves the ankle collar from the lowered state (i.e., FIGS. 3C and 4C) to the raised state (i.e., FIGS. 3A and 4A) to help secure the footwear article to the wearer's foot.

Among other things, the collar elevators 350 and 450 may reduce potential structural breakdown of the upper heel region and upper ankle region over time, which could result from repeated hands-free donning, by providing a frame operational to return to, or bias in, the raised state. Furthermore, the collar elevators 350 and 450 may allow the user to more easily don (i.e., put on) his or her shoes without the use of hands and/or without having to bend down to tie the laces, without having to use a shoe horn, or without using other such adjustment features, elements, or mechanisms for fit. Moreover, the footwear articles 310 and 410 may more easily receive, or more easily direct a wearer's foot into, or otherwise accommodate, a wearer's foot with respect to, the foot-receiving opening. This potentially easier donning may result from, among other things, the collar elevators 350 and 450 helping to provide a larger foot-insertion opening without allowing a topline of the ankle collar to fold inward towards the foot-receiving cavity.

Operation of the footwear articles 310 and 410 may be described in various manners. For example, the ankle collars 336 and 436 may be elastic or may include a goring element that permits expansion of the foot-insertion openings 318 and 418, such as when the ankle collar is moved to a lowered state. In the lowered state, the foot-insertion openings 318 and 418 may be expanded by at least about 5%, or at least about 10%, or at least about 15%. This measured expansion may be detected in various manners. For example, a first circumference of the foot-insertion opening may be measured when the ankle collar is in a first state, and a second circumference may be measured when the ankle collar is in a second state, which is closer to the sole (relative to the first state). The distance of the ankle collar from the sole in the first and second states may be measured in a vertical plane (i.e., perpendicular relative to the horizontal reference plane, including a flat ground surface on which the ground-contacting surface sits in an at-rest position), and the distance may be measured from a rearmost point of the ankle collar topline edge to a topline edge of the sole (e.g., where the sole connects to the upper at the biteline). As such, the distance in the first state will be longer than the distance in the second state, and in one aspect, the second distance is equal to or shorter than 75% of the first distance. Continuing with the above example, in the second state having the distance equal to or shorter than 75% of the distance in the first state, the circumference may be expanded by at least about 5%, or at least about 10%, or at least about 15%. In a further example, a circumference of the foot-insertion openings 318 and 418 may be expandable by at least about 1.0 inch (about 2.54 centimeters), when the ankle collar is in the second state having the distance equal to or shorter than 75% of the distance in the first state. An amount of the expansion of the foot-insertion opening 318 and 418 may vary with the shoe style and size. In other aspects, a height of the ankle collars 336 and 436 above the soles 312 and 412 in the lowered state is about 50% lower than the height in the raised state, however, as with other parameters, this may vary depending on the shoe style and size.

As described in other portions of this disclosure, the collar elevators 350 and 450 provide a return force when moving the ankle collars 336 and 436 from the lowered state to the raised state. In some aspects, the return force is between about 1 pound-force and about 15 pound-force, and this may be measured at various positions of the ankle collar. For example, as explained above, the ankle collar may include a first state having a first distance from the sole and a second state having a second distance from the sole, which is shorter than the distance in the first state. In one aspect, the collar elevators 350 and 450 provide the return force between about 1 pound-force and about 15 pound-force in the second state having the distance equal to or shorter than about 85% of the distance in the first state. In a further aspect, the collar elevators 350 and 450 provide the return force between about 1 pound-force and about 15 pound-force in the second state having the distance equal to or shorter than about 75% of the distance in the first state. Further still, the collar elevators 350 and 450 might provide the return force between about 1 pound-force and about 15 pound-force in the second state having the distance equal to or shorter than about 50% of the distance in the first state. The return force may be strong enough such that the rear of the ankle collar rebounds back up from the second state and snugly fits around the wearer's heel. For example, the ankle collars 336 and 436 may be elevated from the lowered state to the raised state in less than about 1 second, when the distance between the ankle collar and the sole in the lowered state is shorter than 85%, or shorter than 75%, or shorter than 50% of the distance in the raised state. In other aspects, ankle collars 336 and 436 may be elevated from the lowered state to the raised state in less than about 0.5 seconds, when the distance between the ankle collar and the sole in the lowered state is shorter than 85%, or shorter than 75%, or shorter than 50% of the distance in the raised state. And in further aspects, the ankle collars 336 and 436 may be elevated from the lowered state to the raised state in less than about 0.2 seconds, when the distance between the ankle collar and the sole in the lowered state is shorter than 85%, or shorter than 75%, or shorter than 50% of the distance in the raised state. This rebound time is measured absent any counteracting external forces, such as friction that might be imparted by the wearer's heel.

Figure 5:
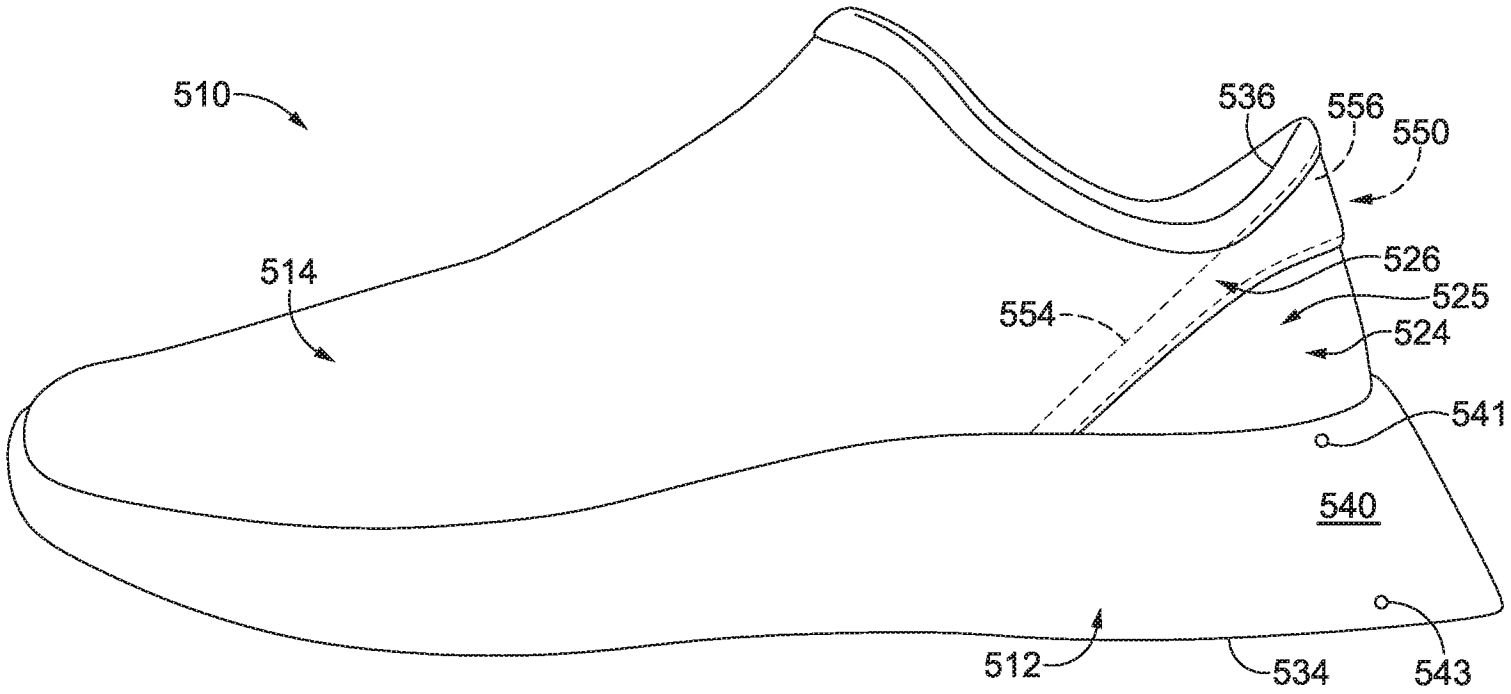
FIG. 5 depicts another footwear article in accordance with an aspect of this disclosure.
Figure 6:
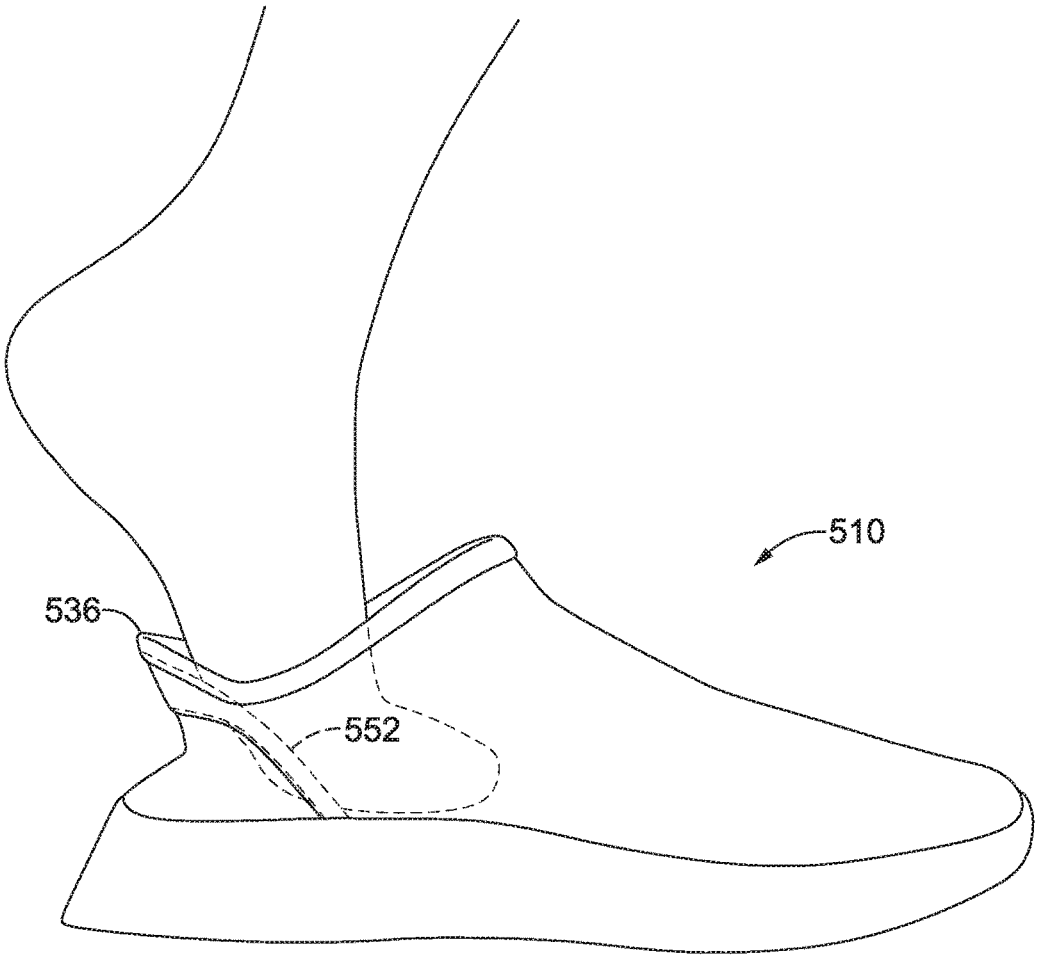
FIG. 6 depicts the footwear article of FIG. 5 with the ankle collar in a lowered state in accordance with an aspect of this disclosure.
Figure 7:
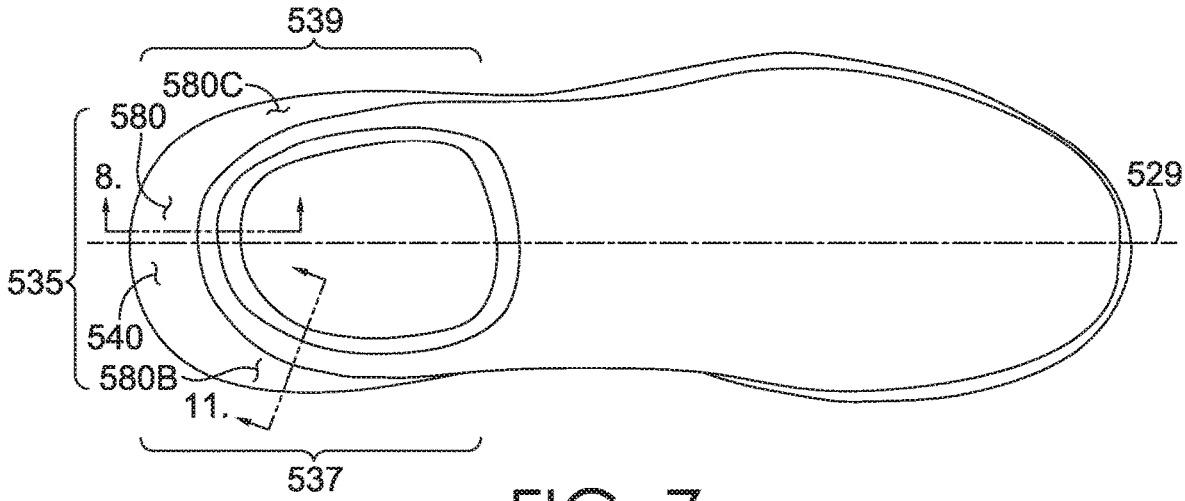
FIG. 7 depicts a top view of the footwear article of FIG. 5 in accordance with an aspect of this disclosure.

Referring now to FIGS. 5-7, another footwear article 510 is described having an upper 514 coupled to a sole 512, and FIG. 5 depicts a lateral side of the footwear article 510. The upper 514 includes a heel region 524 and an ankle region 526 having an ankle collar 536. The ankle collar 536 is movable between a lowered state (e.g., FIG. 6) positioned closer to the sole 512 and a raised state (e.g., FIG. 5) positioned farther from the sole 512. In addition, the footwear article 510 includes a collar elevator 550 coupled to the heel region 524 of the upper, to the ankle region 526 of the upper, near or to the ankle collar 536, or to any combination thereof, and operable to move the ankle collar 536 from the lowered state to the raised state. For example, as explained in other portions of this disclosure, the center connecting band 556 may be affixed to (or near) the rear portion of the ankle collar 536, and/or the lever arms 552 and 554 may be affixed to the heel region 524 of the upper. The collar elevator 550 that is illustrated in FIGS. 5 and 6 is an example of one type of collar elevator, and in other aspects of this disclosure, the footwear article 510 may include any of a variety of other collar elevators disclosed in this specification. The upper 514 is tongue-less, such that the vamp extends all the way from the forefoot region up to the front, topline edge of the ankle collar 536. In an alternative aspect, the upper 514 might include a throat (e.g., 38), a tongue (e.g., 42), and a closure system (such as hook-and-loop straps, elastic bands, laces 44, and the like).

The sole 512 includes a sidewall 540. The sidewall 540 is a surface of the sole that extends around at least a portion of the sole perimeter. Typically, a sidewall extends from a more superior portion near the upper (e.g., portion 541 near the top edge of the sole that joins with the upper at a biteline) to a more inferior portion that is closer the ground-contacting surface (e.g., portion 543). In some instances, the sidewall 540 may gradually transition to a ground-contacting surface with a more rounded corner at the junction between the sidewall and ground-contacting surface. In other instances, the transition from the sidewall to a ground-contacting surface may be less gradual and represented by a sharper corner edge at the transition. If a footwear article includes a midsole (e.g., foam midsole) then at least a portion of the sidewall is often formed by the midsole. The sidewall may also be formed by a cupsole or by a perimeter edge of an outsole. The sidewall 540 in FIG. 5 is relatively flat with little to no surface changes. In other aspects, a sidewall may include various curvatures, slope changes, indentions, dimples, nodes, protrusions, recesses, grooves, ribs, sipes, and the like.

Figure 8:
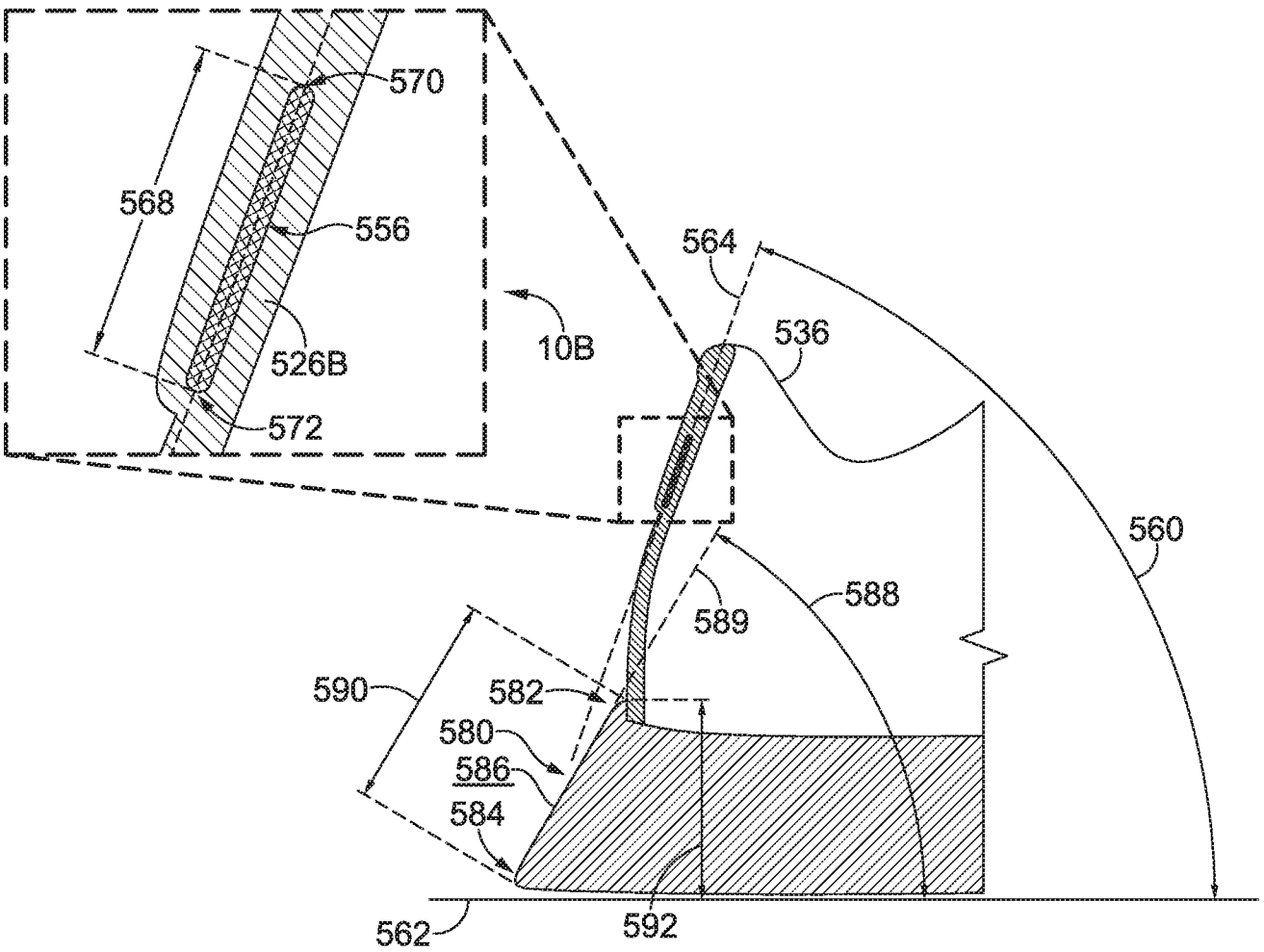
FIG. 8 depicts a cross-sectional view of the footwear article of FIG. 5 in accordance with an aspect of this disclosure.

As previously described, the footwear article 510 includes a collar elevator 550. The collar elevator 550 includes a center connecting band 556 located in or near a rear portion of the ankle collar 536. Referring to FIG. 8, a cross-sectional view is illustrated, taken along the longitudinal midline reference plane 529. As explained in other portions of this disclosure, the longitudinal midline reference plane extends in a generally vertical orientation (perpendicular to a ground surface on which the ground-contacting surface is resting), and passes through the rearmost point of the footwear article 510 and the foremost point of the footwear article. As illustrated in FIG. 8, the center connecting band 556 includes a forwardly inclined angle 560, relative to a horizontal reference plane 562 when the ankle collar 536 is in the raised state. The horizontal reference plane 562 generally includes the plane of a relatively flat ground surface on which the ground-contacting surface rests with the footwear article being stationary, in an at-rest state.

The forwardly inclined angle 560 might be determined in various manners, based on a configuration of the center connecting band 556. For example, FIG. 8 depicts a cross section of the center connecting band 556, and a zoomed-in view 10B is provided to more easily view a cross-sectional, 2D form or shape of the center connecting band 556. The 2D form is illustrated as being either rectangular with curved corners, ovular, or an elongated pill-shaped. In addition, the center connecting band 556 includes a length 568 extending from a first endpoint 570 along the longitudinal orientation to a second endpoint 572 along the longitudinal orientation. The 2D form in FIG. 8 is representative of one aspect of the disclosure, and in other aspects, the 2D form may have various shapes. For example, referring to FIGS. 9A-9G, a plurality of alternative cross-sectional, 2D forms are illustrated, and a cross section of the center connecting band might alternatively include one or more of these 2D forms. It should be noted that relative directional references "anterior" and "posterior" have been positioned in FIGS. 9A-9G to correspond with respective directions in the footwear article 510.

Figure 9A:
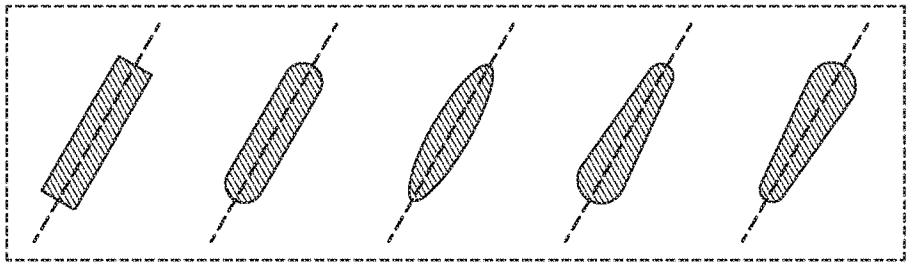
FIGS. 9A-9G depict alternative center connecting bands in accordance with an aspect of this disclosure.
Figure 9B:
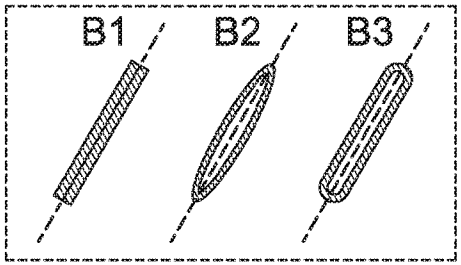
Figure 9C:
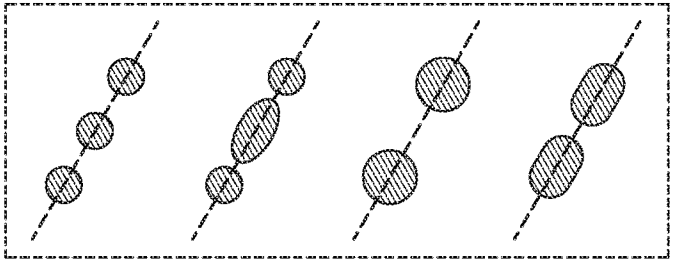
Figure 9D:
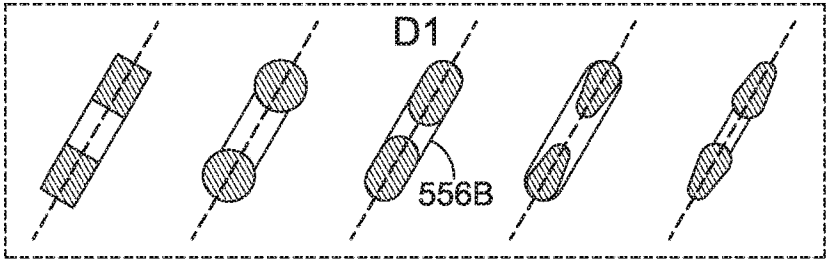
Figure 9E:
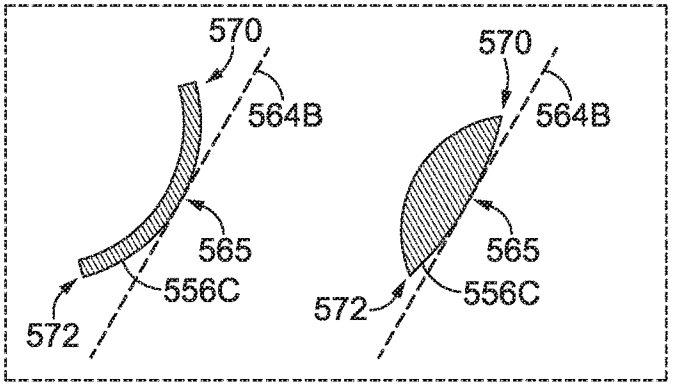

FIGS. 9A-9G are organized into groups of cross-sectional 2D forms that might be included in alternative aspects of the center connecting band. For example, FIG. 9A represents center connecting bands that might include a single solid body. FIG. 9B represents center connecting bands that might include an anterior layer or wall and a posterior layer or wall, possibly with a space in between. For example, B1 includes an anterior layer and a posterior layer affixed to one another without any space therebetween, and B2 and B3 each includes a space. FIG. 9C includes center connecting bands having a plurality of discrete elongated members (in the medial to lateral direction), such as slats, which may be disconnected from one another and spaced apart, at least within the region of the center connecting band. FIG. 9D includes center connecting bands having discrete bridges and/or necks that extend between, and connect to, paddles or other support structures within the center connecting bands. For example, in the cross sectional view of D1, reference numeral 556B identifies a lateral side paddle.

In accordance with one aspect of this disclosure, the angle reference line 564 may be measured along a longitudinal reference axis that bisects the cross-sectional 2D form(s) into substantially symmetrical mirror images. For example, in FIGS. 9A-9D, each example 2D form in Groups 9A-9D is illustrated to include a respective longitudinal reference axis that bisects the cross-sectional 2D form into substantially symmetrical mirror images and that might be used to determine the angle reference line 564 in a center connecting band including a cross section having that particular 2D form.

Figure 9F:
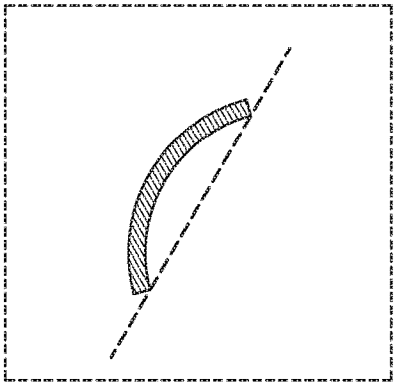
Figure 9G:
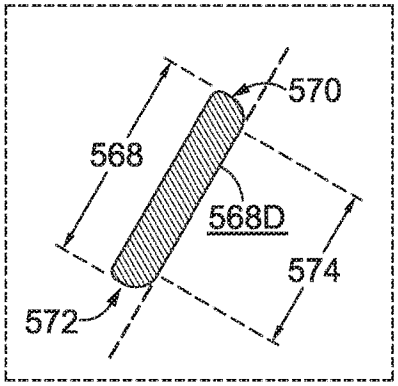

Alternative methods may be used to locate and measure the angle reference line 564. For example, in some instances, the cross-sectional 2D form of a center connecting member may not be symmetrical on opposing sides of a bisecting, longitudinal reference axis, such that the method described above would not apply. Instead, the cross-sectional 2D form may present other features that could be usable to determine an angle reference line. For example, referring to FIG. 9E, the cross-sectional 2D form may include an anterior endpoint 570, a posterior endpoint 572, and a convex anterior surface 556C extending between the anterior endpoint and the posterior endpoint 572, in which case a tangent line 564B positioned at an arc midpoint 565 may be used to determine the angle reference line. In other instances, as illustrated by FIG. 9F, the cross-sectional 2D form may include a concave anterior surface, in which case the angle reference line may extend through the arc endpoints.

Another method of identifying the angle reference line might be based on a relatively straight and flat anterior surface of the 2D form. For example, in FIG. 9G the 2D form of the cross-sectional view includes a relatively flat and straight anterior surface 556D. In addition, the 2D form in FIG. 9G includes a length 568 extending from first endpoint 570 along the longitudinal orientation to a second endpoint 572 along the longitudinal orientation. In accordance with one aspect of the disclosure, the angle reference line may be established along (i.e., parallel and collinear with) the anterior surface 556D when a flat portion of the anterior surface includes a straight-surface height 574 that is equal to or greater than 50% of the center-connecting-band length 568.

If none of the above described methods are applicable to a given 2D form, then the angle reference line 564 may be positioned along a reference line that is evenly spaced between a superior most point of the 2D form and an anterior most point of the 2D form and between an inferior most point and a posterior most point. If there are more than one superior most points, then the superior most point that is the most anterior (compared with the other superior most points) is selected, and if there are more than one anterior most points, then the anterior point that is most superior is selected. Likewise, if there are more than one inferior most points, then the inferior most point that is also the most posterior is selected, and if there are more than one posterior most points, then the posterior point that is most inferior is selected.

In accordance in an aspect of the disclosure, if the structure of the center connecting band, including the cross-sectional 2D form, is conducive to using more than one of the above described methods to identify a potential angle reference line, then the angle reference line that provides the smallest angle is selected to determine the forwardly inclined angle 560.

The forwardly inclined angle 560 contributes to one or more operations of the footwear article in various manners. For example, as compared with a more upright center connecting band, a center connecting band having a smaller forwardly inclined angle may provide a larger overhanging catch surface, which can impede a wearer's foot from slipping relative to a heel portion of the footwear article. Even though an inner lining material (e.g., 526B in FIG. 8) may cover the center connecting band, the center connecting band can still provide a rigid backing to impede heel slippage out of the foot-insertion opening.

In an aspect of this disclosure, a center connecting band having a forwardly inclined angle may also impede removal of the footwear article, such as when the wearer attempts to pull his or her foot from the footwear article. For example, a wearer's heel may catch on the heel portion or rear ankle collar, which is supported by the center connecting band, when the wearer attempts to slide his or her foot from the foot-insertion opening. In this sense, the interaction between the foot and the center connecting band generates forces having vectors that are substantially perpendicular to the angle reference line, and an example of the vector of the force generated by the center connecting band's resistance is identified by arrow "A" in FIG. 10. In turn, a vector of the foot's force on the center connecting band is in the opposite direction to the arrow A and is represented by arrow B, since the force vector is influenced by the forward incline of the center connecting band. As previously indicated, in some instances, the heel-counter region 525 may include a more flexible wall, which can also permit rearward travel of a wearer's heel when slipping the heel out of the foot-insertion opening, and this rearward travel may contribute to the wearer's heel catching on the center connecting band. In this disclosure, the term "doffing" generally describes the act of taking off a footwear article.

Absent one or more aspects of this disclosure, a wearer might dig his/her toes, or the ball of his/her foot, into the footbed to gain traction for pulling his/her heel past the center connecting band. Alternatively (or additionally) the wearer might change or alter a path along which the wearer pulls his/her heel to move around and bypass the center connecting band. Moreover, the wearer might have to use his or her hands to assist with doffing the shoe. Further still, to remove the shoe of a left foot, the wearer might have to step with his/her right foot onto the heel counter of the left shoe, which can cause the upper materials to delaminate, pull away from the sole, or otherwise breakdown. However, to avoid or reduce some of these issues, an aspect of this disclosure includes a doffing ledge that is in a heel portion of the sole, and the doffing ledge provides a surface against which a wearer can depress with his or her opposing foot to assist with removing the footwear article (see e.g., FIG. 10).

In FIG. 8, a doffing ledge 580 is formed by the sidewall of the footwear article 510. The doffing ledge 580 protrudes outwardly from a doffing-ledge first portion 582 closer to the upper 514 to a doffing-ledge second portion 584 farther from the upper 514. Moreover, the doffing ledge comprises a doffing surface 586 that declines at a doffing angle 588 as it extends from the doffing-ledge first portion 582 to the doffing-ledge second portion 584. Similar to the forwardly inclined angle 560, the doffing angle 588 is relative to the horizontal reference plane 562. Further, in one aspect, the doffing-angle reference line 589 extends collinear and parallel with the doffing surface 586.

The doffing ledge 580 provides one example, and in accordance with an aspect of this disclosure, one or more doffing ledges may be positioned at one or more locations along the sidewall 540. For example, in FIG. 8, the doffing ledge 580 is substantially aligned with a longitudinal midline reference plane 529 (identified in FIG. 7), and in other aspects, the doffing surface may extend along a medial side 537 of the heel region (see e.g., FIG. 7), along a lateral side 539 of the heel region, along a medial-to-lateral transverse portion 535 of the heel region, or any and all combinations thereof. For example, the sidewall 540 and the doffing surface 586 may continuously wrap from the medial side 537 to the transverse portion 535, from the lateral side 539 to the transverse portion 535, or all the way from the medial side 537 to the lateral side 539. As such, in accordance with an aspect of this disclosure, and referring to FIG. 11, another doffing ledge 580B is formed by the sidewall of the footwear article 510 on the medial side 537 of the heel region. A position on the medial side 537 may provide some differences over the position of the doffing ledge 580, which is more in the transverse portion 535, aligned with the longitudinal midline reference plane. For example, a position on the medial side 537 might be conducive to engagement with the medial side of the footwear article on the opposing foot with the medial portion or ball of the opposing foot. In another aspect, another doffing ledge 580C might be formed by the sidewall of the footwear article 510 on the lateral side 539 of the heel region. A position on the lateral side 539 may provide some differences over the position of the other doffing ledges 580 and 580B. For example, a position on the lateral side 539 might be conducive to engagement with the lateral side of the footwear article on the opposing foot or with the lateral portion of the opposing foot. Although numbered separately for explanatory purposes, the doffing ledges 580, 580B, and 580C might be considered a single doffing ledge with different regions or portions at different locations of the sidewall 540.

Figure 11:
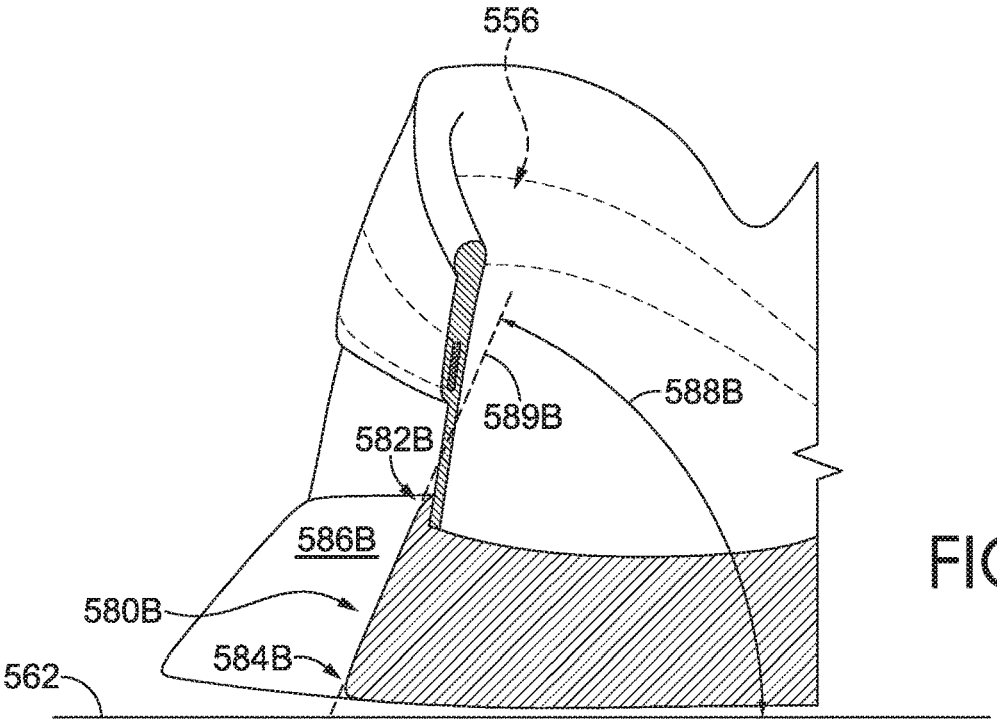
FIG. 11 depicts another doffing ledge in accordance with an aspect of this disclosure.

In FIG. 11, the doffing ledge 580B protrudes outwardly from a doffing-ledge first portion 582B closer to the upper 514 to a doffing-ledge second portion 584B farther from the upper 514. Moreover, the doffing ledge 580B comprises a doffing surface 586B that declines at a doffing angle 588B as it extends from the doffing-ledge first portion 582B to the doffing-ledge second portion 584B. Similar to the forwardly inclined angle 560, the doffing angle 588B is relative to the horizontal reference plane 562. Further, in one aspect, the doffing-angle reference line 589B extends collinear and parallel with the doffing surface 586. Although a cross-sectional view of the doffing ledge 580C is not explicitly provided in this disclosure, it is understood that the doffing ledge 580C, as well as any other doffing ledge in accordance with this disclosure, protrudes outwardly from a doffing-ledge first portion closer to the upper to a doffing-ledge second portion farther from the upper, the doffing ledge having a doffing surface that declines from the doffing-ledge first portion to the doffing-ledge second portion at a doffing angle.

Figure 10:
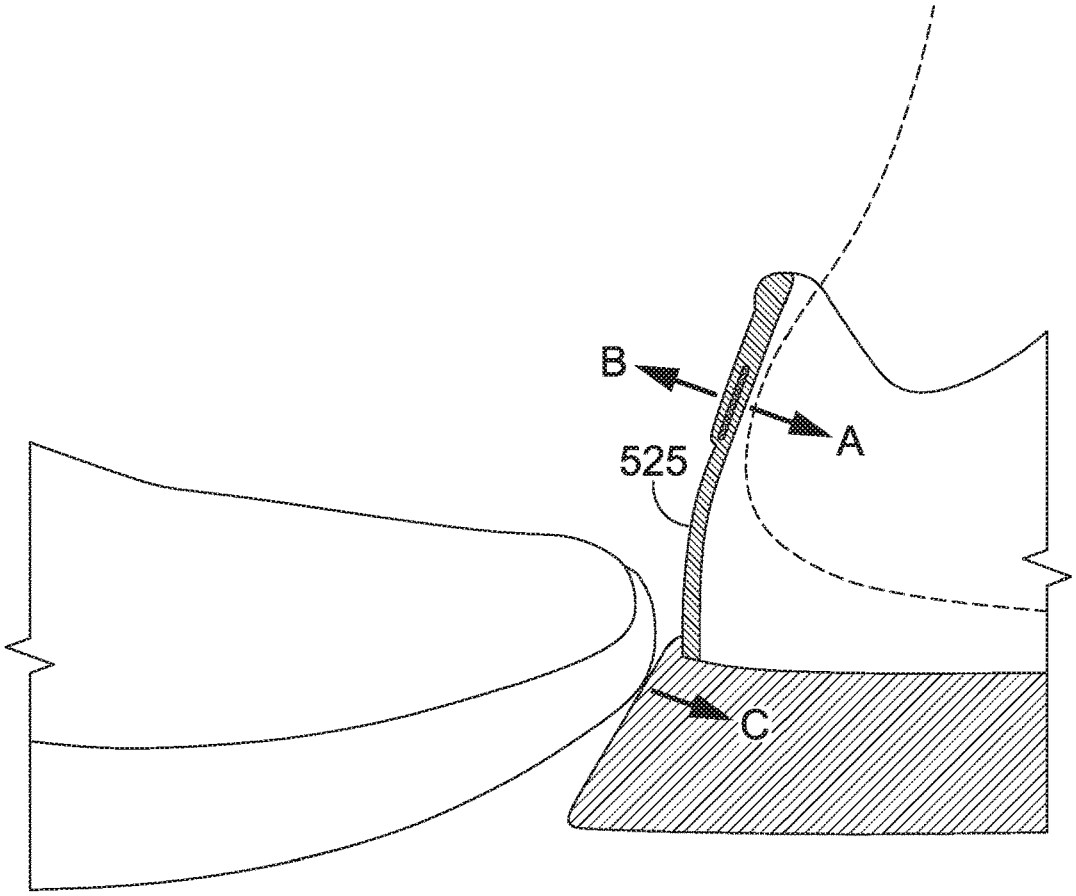
FIG. 10 depicts doffing of a footwear article in accordance with an aspect of this disclosure.

In some instances, the operability of the doffing ledges (e.g., 580, 580B, and 580C) to assist with removing a shoe (e.g., in a hands-free manner) depends at least in part on a size of the doffing angle relative to the forwardly inclined angle 560. For example, in an aspect of this disclosure, the doffing angle is less than the forwardly inclined angle 560. By applying this standard to the doffing angles, a force vector (e.g., Arrow C in FIG. 10) created by the opposing foot can be guided more vertically downward to help overcome the force of the foot against the center connecting band (e.g., Arrow B). Stated differently, the force applied to a doffing ledge with a smaller doffing angle (i.e., approaching horizontal and parallel with the horizontal reference plane 562) will be directed more vertically downward than a doffing ledge with a higher doffing angle. In FIG. 10, the force vector C is more vertically oriented than the force vector B, which can assist the wearer with overcoming the force of the center connecting band when removing the footwear article. Even though the doffing ledge 580B is not necessarily vertically aligned with the center connecting band 556, the operability of the doffing ledge 580B might still be configured based on the forwardly inclined angle 560. As such, in an aspect of the disclosure, the doffing angle 588B (in FIG. 11) of the doffing ledge 580B positioned on the medial side 537 is less than the forwardly inclined angle 560 (in FIG. 8).

In accordance with an aspect of the present disclosure, the forwardly inclined angle 560 of the center connecting band is in a first range of 45 degrees to 70 degrees, and the forwardly inclined angle within this range might be included in a footwear article for various reasons. For example, the forwardly inclined angle within this first range might be selected to provide some additional heel-securing functionality (i.e., impede heel slippage and snug up against the wearer's heel while the footwear is being worn). In another example, the forwardly inclined angle within this first range might provide a desired esthetic contour in a rear portion of the ankle region or ankle collar. In a further aspect, the forwardly inclined angle 560 of the center connecting band is in a second range of 50 degrees to 65 degrees, and as compared with the first range, this second range omits some angles that might not provide sufficient heel security and omits other angles that might provide too much resistance to doffing. With these same considerations in mind and for further refinement, in further aspects, the forwardly inclined angle may be in a range of 52 degrees to 62 degrees.

In another aspect of the disclosure, the forwardly inclined angle 560 is in the first range of 45 degrees to 70 degrees and the doffing angle is equal to or less than the forwardly inclined angle and is in a third range of 30 degrees to 70 degrees. The third range for the doffing angle may extend to smaller degrees, as compared with the range for the forwardly inclined angle, since it might be desirable to select doffing angles that are several degrees less than the forwardly inclined angle. For example, if a forwardly inclined angle 560 is 45 degrees, then it may be desirable for a doffing ledge to have a doffing angle of 30 degrees to create enough leverage on the doffing ledge to hold the footwear article in position while attempting to pull a foot out. Provided that the doffing angle is equal to or less than the forwardly inclined angle, in another aspect, the doffing angle may be in a fourth range of about 40 degrees to about 60 degrees, and as compared with the third range, this second range omits some larger angles that might not provide sufficient leverage and omits some smaller angles that may generate surfaces jutting too far outward from a sidewall. With these same considerations in mind and for further refinement, in further aspects, the doffing angle may be in a fourth range of about 45 degrees to about 55 degrees.

In another aspect of the disclosure, the doffing surface (e.g., 586 and 586B) includes a length 590 that is measured along a substantially flat portion of the doffing surface (in the vertical reference plane) and that satisfies a minimum length threshold. In one example, the doffing-surface length 590 might be at least 75 percent of the center-connecting-band length 568. In a further example, the doffing-surface length 590 might be at least 90 percent of the center-connecting-band length 568. In an additional aspect, the doffing-surface length 590 might be at least as long as the center-connecting-band length 568. In a further aspect, the doffing-surface length 590 might be at least 130 percent (e.g., one and one-third is at least 130%) of the center-connecting-band length 568. In an alternative aspect, the doffing-surface length 590 is at least 150 percent (i.e., one and one-half) of the center-connecting-band length 568. The minimum length threshold might be based on other standards as well. For example, the doffing-surface length 590 might be at least one-third of the sole height 592, which extends from a superior-most point of the sole (in the vertical reference plane) to the horizontal reference plane (as defined in other portions of this disclosure). In another example, the doffing-surface length 590 is at least 50 percent of the sole height. In a further aspect, the doffing-surface-length 590 is at least 75 percent of the sole height. In yet another aspect, the doffing-surface length 590 is equal to or greater than the sole height.

From the foregoing, it will be seen that this invention is one well adapted to attain all the ends and objects hereinabove set forth together with other advantages which would be realized by an ordinary skilled artisan and which are inherent to the structure.

It will be understood that certain features and subcombinations are of utility and may be employed without reference to other features and subcombinations. This is contemplated by and is within the scope of the claims.

Since many possible aspects may be made of the invention without departing from the scope thereof, it is to be understood that all matter herein set forth or shown in the accompanying drawings is to be interpreted as illustrative and not in a limiting sense.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A footwear article comprising: a sole having a ground-contacting surface and a sidewall; an upper coupled to the sole and comprising an ankle collar that is movable between a lowered state positioned closer to the sole and a raised state positioned farther from the sole; a collar elevator operable to return the ankle collar from the lowered state to the raised state, the collar elevator having a medial lever arm, a lateral lever arm, and a center connecting band that couples the medial lever arm to the lateral lever arm and that is located near a rear portion of the ankle collar, wherein the center connecting band comprises a forwardly inclined angle equal to or less than 65 degrees relative to a horizontal reference plane when the ankle collar is in the raised state; and the sidewall comprising a doffing ledge that is in a heel portion of the sole and that protrudes outwardly from a doffing-ledge first portion closer to the upper to a doffing-ledge second portion farther from the upper, wherein the doffing ledge comprises a doffing surface that declines from the doffing-ledge first portion to the doffing-ledge second portion at a doffing angle, which is relative to the horizontal reference plane and is less than the forwardly inclined angle.

Clause 2. The apparatus of any of the clauses, wherein the medial lever arm includes a first end coupled to the center connector and a second end coupled to a base, and wherein the lateral lever arm includes a third end coupled to the center connector and a fourth end coupled to the base.

Clause 3. The apparatus of any of the clauses, wherein the base is layered below an insole and above a midsole.

Clause 4. The apparatus of any of the clauses, wherein the base wraps around a backside of the footwear article and below the center connecting band.

Clause 5. The apparatus of any of the clauses, wherein the forwardly inclined angle is equal to or less than 55 degrees.

Clause 6. The apparatus of any of the clauses, wherein the doffing ledge is positioned on a medial side of the sole of the footwear article.

Clause 7. The apparatus of any of the clauses, wherein the doffing surface is aligned with a midline reference plane, which passes through a rearmost point and a foremost point of the footwear article.

Clause 8. The apparatus of any of the clauses, wherein the doffing ledge is positioned on a lateral side of the sole of the footwear article.

Clause 9. The apparatus of any of the clauses, wherein the doffing surface comprises a doffing-surface length extending from the doffing-ledge first portion to the doffing-ledge second portion; wherein at the doffing ledge the sole includes a sole height; and wherein the doffing-surface length is equal to or larger than one-half of the sole height.

Clause 10. The apparatus of any of the clauses, wherein the doffing surface is substantially flat in a vertical reference plane extending perpendicular to the horizontal reference plane.

Clause 11. The apparatus of any of the clauses, wherein the doffing-surface second portion extends to an outsole.

Clause 12. A footwear article comprising: a sole having a ground-contacting surface and a sidewall; an upper coupled to the sole and comprising an ankle collar that is movable between a lowered state positioned closer to the sole and a raised state positioned farther from the sole; a collar elevator operable to return the ankle collar from the lowered state to the raised state, the collar elevator having a medial lever arm, a lateral lever arm, and a center connecting band that couples the medial lever arm to the lateral lever arm and that is located near a rear portion of the ankle collar, wherein the center connecting band comprises a forwardly inclined angle in a range of 70 degrees to 45 degrees relative to a horizontal reference plane when the ankle collar is in the raised state; and the sidewall comprising a doffing ledge that is in a heel portion of the sole and that protrudes outwardly from a doffing-ledge first portion closer to the upper to a doffing-ledge second portion farther from the upper, wherein the doffing ledge comprises a doffing surface that declines from the doffing-ledge first portion to the doffing-ledge second portion at a doffing angle, which is relative to the horizontal reference plane and is less than the forwardly inclined angle.

Clause 13. The apparatus of any of the clauses, wherein the forwardly inclined angle is in a range of 65 degrees to 50 degrees.

Clause 14. The apparatus of any of the clauses, wherein the forwardly inclined angle is in a range of 52 degrees to 62 degrees.

Clause 15. The apparatus of any of the clauses, wherein the doffing angle is greater than 30 degrees.

Clause 16. The apparatus of any of the clauses, wherein the doffing angle is in a range between 40 degrees and 60 degrees.

Clause 17. The apparatus of any of the clauses, wherein the doffing angle is in a range between 45 degrees and 55 degrees.

Clause 18. A footwear article comprising: a sole having a ground-contacting surface and a sidewall; an upper coupled to the sole and comprising an ankle collar that is movable between a lowered state positioned closer to the sole and a raised state positioned farther from the sole; a collar elevator operable to return the ankle collar from the lowered state to the raised state, the collar elevator having a medial lever arm, a lateral lever arm, and a center connecting band that couples the medial lever arm to the lateral lever arm and that is located near a rear portion of the ankle collar, wherein the center connecting band comprises a forwardly inclined angle equal to or less than 65 degrees relative to a horizontal reference plane when the ankle collar is in the raised state, and wherein the center connecting band includes a length extending from a first endpoint along a longitudinal orientation to a second endpoint along the longitudinal orientation; and the sidewall comprising a doffing ledge that is in a heel portion of the sole and that protrudes outwardly from a doffing-ledge first portion closer to the upper to a doffing-ledge second portion farther from the upper, wherein the doffing ledge comprises a doffing surface that declines from the doffing-ledge first portion to the doffing-ledge second portion at a doffing angle, which is relative to the horizontal reference plane and is less than the forwardly inclined angle; wherein the doffing surface comprises a doffing-surface length extending from the doffing-ledge first portion to the doffing-ledge second portion; and wherein the doffing-surface length is equal to or larger than one and one-third of the length.

Clause 19. The apparatus of any of the clauses, wherein the doffing-surface length is equal to or larger than one and one-half of the length.

Clause 20. The apparatus of any of the clauses, wherein the doffing ledge is positioned on a medial side of the sole of the footwear article.

The invention claimed is:

1. A footwear article comprising:

a sole;

an upper coupled to the sole and comprising an ankle collar that is movable between a lowered state positioned closer to the sole and a raised state positioned farther from the sole, the upper including an exterior layer and an inner lining; and a collar elevator operable to return the ankle collar from the lowered state to the raised state, the collar elevator comprising:

a medial lever arm;

a lateral lever arm;

a center connecting band that couples the medial lever arm to the lateral lever arm and that is located near a rear portion of the ankle collar, wherein, at an intersection with a longitudinal midline reference plane, the center connecting band comprises a rectangular-shaped cross section having a length in a superior-inferior orientation; and a base that is affixed at a first junction to the medial lever arm and at a second junction to the lateral lever arm, the base continuously extending from the first junction, around a backside of the footwear article, to the second junction, wherein the medial lever arm, the lateral lever arm, the center connecting band, and the base comprise a uniform thickness between an inner side facing towards a foot receiving cavity and an outer side facing away from the foot receiving cavity; wherein the center connecting band comprises an anterior material layer affixed to a posterior material layer; wherein the anterior material layer and the posterior material layer are affixed face-to-face without a space between the anterior material layer and the posterior material layer; and wherein the anterior material layer and the posterior material layer each extend the length of the center connecting band.

2. The footwear article of claim 1, wherein the medial lever arm forms a first acute angle with the base at the first junction, and wherein the lateral lever arm forms a second acute angle with the base at the second junction.

3. The footwear article of claim 1, wherein the medial lever arm, the lateral lever arm, the center connecting band, and the base comprise a single continuous body.

4. The footwear article of claim 1, wherein at the intersection with the longitudinal midline reference plane, the center connecting band is oriented at a forwardly inclined angle in a range of between 45 degrees and 70 degrees.

5. A footwear article comprising a collar elevator, the collar elevator comprising:

a deformable element comprising:

a base having a first base end, a second base end, and a base thickness between a base first side and a base second side;

a first lever arm attached to the first base end at a first junction of the base and the first lever arm, the first lever arm comprising a first-lever-arm thickness between a first-lever-arm first side and a first-lever-arm second side;

a second lever arm attached to the second end at a second junction of the base and the second lever arm, the second lever arm comprising a second-lever-arm thickness between a second-lever-arm first side and a second-lever-arm second side; and a center connecting band that couples the first lever arm to the second lever arm and that comprises a center-connecting-band thickness between a center-connecting-band first side and a center-connecting-band second side, wherein:

the base thickness, the first-lever-arm thickness, the second-lever-arm thickness, and the center-connecting-band thickness comprise a uniform thickness;

the center connecting band comprises an anterior material layer affixed face-to-face with a posterior material layer without a space between the anterior material layer and the posterior material layer;

in a respective cross section, which is relative to a longitudinal midline reference plane of the footwear article, the center connecting band includes a shape that is symmetrical relative to a longitudinal reference axis of the center connecting band and that includes a length larger than a width;

the anterior material layer and the posterior material layer extend an entirety of the length; and the deformable element is operable to return an ankle collar of the footwear from a lowered state to a raised state.

6. The footwear article of claim 5, wherein the collar elevator is positioned in the footwear article to return an ankle collar from a lowered state to a raised state; wherein the first junction is on a medial side of the footwear article and the second junction is on a lateral side of the footwear article; wherein the base extends from the medial side, around a backside of the footwear article, to the lateral side; and wherein the center connecting band is positioned near a rear portion of the ankle collar.

7. The footwear article of claim 5, wherein in the cross section, the center connecting band comprises a rectangular shape.

8. The footwear article of claim 5, wherein the anterior layer is an innermost layer of the collar elevator and the posterior layer is an outer layer of the collar elevator.

* * * * *